US012128294B2

(12) United States Patent
Indulti et al.

(10) Patent No.: US 12,128,294 B2
(45) Date of Patent: Oct. 29, 2024

(54) ADAPTED TOE-PIECE OF A SKI BINDING FOR ALSO ALLOWING WALKING UPHILL

(71) Applicant: ATK SPORTS S.r.l., Fiorano Modenese (IT)

(72) Inventors: Davide Indulti, Fiorano Modenese (IT); Giovanni Indulti, Fiorano Modenese (IT); Marco Solarino, Reggio Emilia (IT)

(73) Assignee: ATK SPORTS S.r.l. (IT)

( * ) Notice: Subject to any disclaimer, the term of this patent is extended or adjusted under 35 U.S.C. 154(b) by 16 days.

(21) Appl. No.: 18/139,644

(22) Filed: Apr. 26, 2023

(65) Prior Publication Data

US 2023/0347231 A1 Nov. 2, 2023

(30) Foreign Application Priority Data

Apr. 29, 2022 (IT) ..... 102022000008585

(51) Int. Cl.
*A63C 9/08* (2012.01)
*A63C 9/22* (2012.01)

(52) U.S. Cl.
CPC ..... *A63C 9/0805* (2013.01); *A63C 9/22* (2013.01)

(58) Field of Classification Search
CPC ... A63C 9/006; A63C 9/08507; A63C 9/0805; A63C 9/08514; A63C 9/08521
See application file for complete search history.

(56) References Cited

U.S. PATENT DOCUMENTS

| | | | | | |
|---|---|---|---|---|---|
| 4,421,341 | A * | 12/1983 | Krob | A63C 9/0847 | 280/628 |
| 5,050,903 | A * | 9/1991 | Stritzl | A63C 9/005 | 280/625 |
| 9,233,295 | B2 * | 1/2016 | Indulti | A63C 9/086 | |
| 9,526,973 | B2 * | 12/2016 | Ibach | A63C 9/22 | |
| 10,159,890 | B2 * | 12/2018 | Kreuzinger | A63C 9/0844 | |
| 11,229,831 | B2 * | 1/2022 | Bombard | A63C 9/0807 | |
| 11,707,665 | B2 * | 7/2023 | Eckart | A63C 9/086 | 280/611 |
| 11,865,433 | B2 * | 1/2024 | Loichinger | A63C 9/086 | |
| 11,998,832 | B2 * | 6/2024 | Eckart | A63C 9/006 | |
| 2023/0256319 | A1 * | 8/2023 | Indulti | A63C 7/005 | 280/604 |
| 2023/0347231 | A1 * | 11/2023 | Indulti | A63C 9/22 | |
| 2024/0165489 | A1 * | 5/2024 | Eberwein | A63C 9/0053 | |
| 2024/0181326 | A1 * | 6/2024 | Coletti | A63C 9/10 | |

* cited by examiner

*Primary Examiner* — Jeffrey J Restifo
(74) *Attorney, Agent, or Firm* — Endurance Law Group PLC

(57) ABSTRACT

A toe-piece of a ski binding includes rotatable first and second clamping members respectively provided with first and second jaws. First and second rotatable supports rotatably bear the first clamping member and the second clamping member, respectively. In a ski descent configuration, the first and second jaws can elastically retract if solicited by a tip of a ski boot. The first clamping member has a third jaw with a first pin, while the second clamping member has a fourth jaw with a second pin. Locking means are provided which when the ski boot tip is between the third and fourth jaws, the blocking means are activatable to block the third and fourth jaws in angular blocking positions in which the first pin is inserted in a first hole of a ski boot and the second pin is inserted in a second hole of the ski boot, making walking uphill possible.

12 Claims, 25 Drawing Sheets

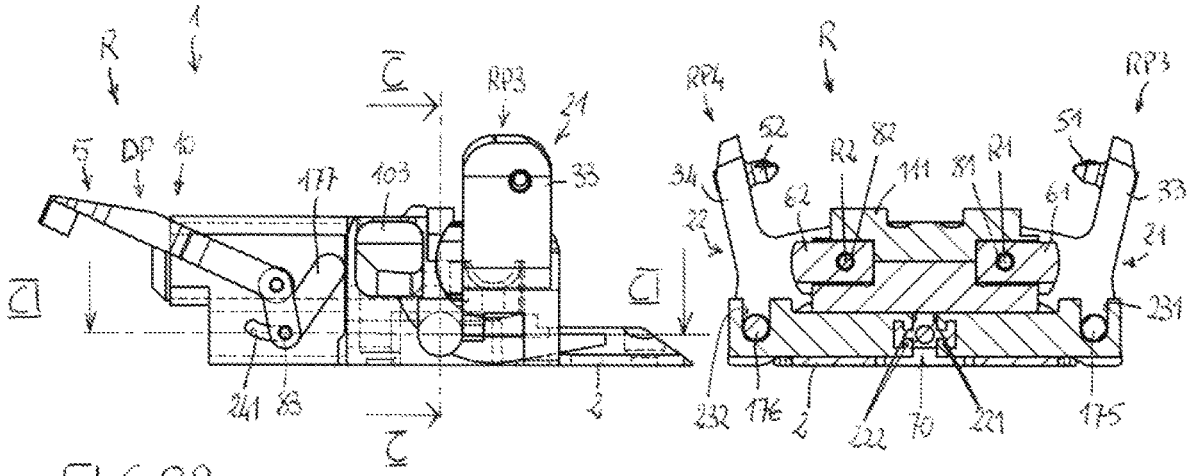
FIG 99
FIG 100
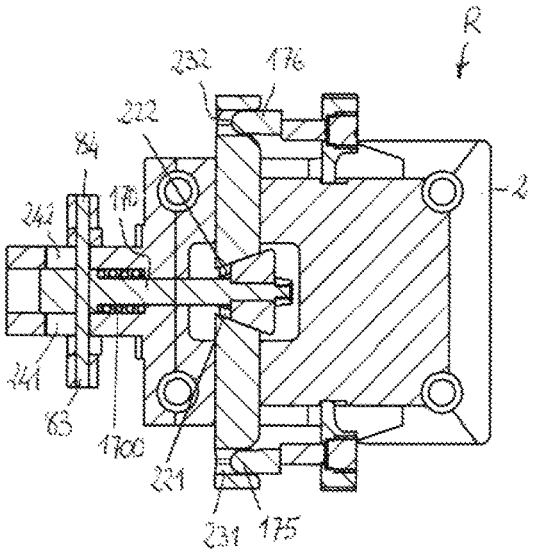
FIG 101
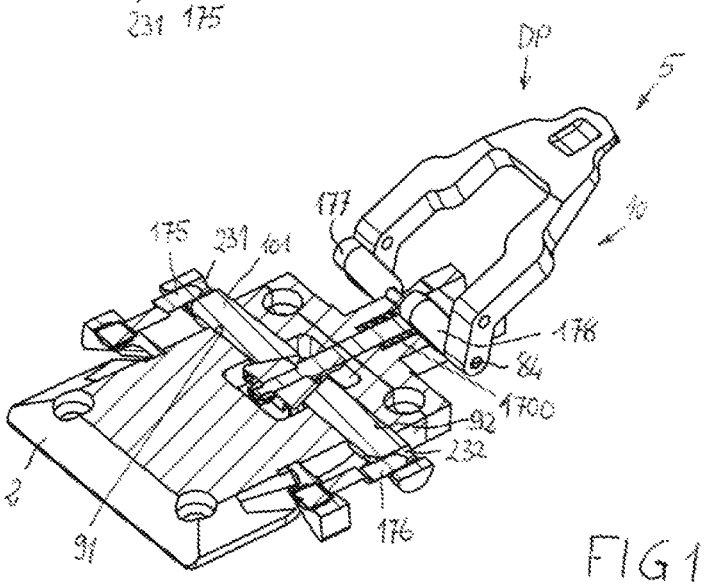
FIG 102

ADAPTED TOE-PIECE OF A SKI BINDING FOR ALSO ALLOWING WALKING UPHILL

The present invention relates to a toe-piece of a ski binding which has been adapted to also enable walking uphill, thus being equivalent to a toe-piece of a ski mountaineering binding.

A toe-piece of a ski binding is known which comprises: a base fixed to a ski; first elastic means which are borne by the base; a first clamping member which is borne by the base, which is rotatable with respect to a first rotation axis and which is provided with a first jaw; a second clamping member which is borne by the base, which is rotatable with respect to a second rotation axis and which is provided with a second jaw. The first hinge axis and the second hinge axis are perpendicular to the ski.

The first jaw assumes a first abutting position able to abut a first lateral portion of the tip of a ski boot, and can elastically retract with respect to the first abutting position, by rotating with respect to the first rotation axis, if solicited by the tip of the ski boot opposing the action of the first elastic means.

The second jaw assumes a second abutting position able to abut a second lateral portion of the tip of the ski boot, opposite the first lateral portion of the tip of the ski boot, and can elastically retract with respect to the second abutting position, by rotating with respect to the second rotation axis, if solicited by the tip of the ski boot against the action of the first elastic means.

This means that during the normal use of the ski binding, both the first jaw and the second jaw abut the tip of the ski boot.

If, differently, the ski boot solicits the first jaw or the second jaw, for example due to an impact or a fall, to the extent that the solicitation exceeds a predetermined threshold value, then the first jaw or the second jaw elastically retracts and the ski boot unhooks from the ski binding, so as to avoid an incident for the skier.

Occasionally, the downhill skier desires to take on adventurous routes that do not comprise only downhill parts, but also "false flats" and/or uphill parts. This is obviously prevented by the fact that the skier is using a toe-piece of a downhill ski binding; indeed, the use of a toe-piece of the ski mountaineering binding is not desirable, as it is relatively unusual to travel over parts that are not downhill and given the radical difference existing between a toe-piece of a downhill ski binding, which the skier is used to, and a toe-piece of a ski mountaineering binding.

The aim of the present invention consists in obviating the above-mentioned drawback.

The above aim is attained by an adapted toe-piece of a ski binding for also allowing walking uphill, according to claim 1.

Thus it is possible to take on any route, comprising downhill parts, on a false flat and uphill, by appropriately adjusting the adapted toe-piece of a ski binding for also allowing walking uphill. To ski downhill, the mode of use is advantageously the one that comprises a toe-piece of a downhill ski binding.

Specific embodiments of the invention will be described in the following part of the present description, according to what is set down in the claims and with the aid of the accompanying tables of drawings, in which:

FIGS. 1-3 are respectively a perspective view, lateral and from above of an adapted toe-piece of a ski binding for also allowing walking uphill, object of the present invention, according to a first embodiment of the invention and in the ski descent configuration, as well as a ski boot that is hooked to the above-mentioned toe-piece of the ski binding for downhill skiing;

FIG. 4 differs from FIG. 1 in that the ski boot is not shown;

FIG. 5 differs from FIG. 4 in that it is in cross section according to a longitudinal section plane;

FIG. 6 is a perspective view alike to that of FIG. 4, but taken from a different angle;

FIG. 7 differs from FIG. 6 in that it is in cross section according to a longitudinal section plane;

FIG. 8 differs from FIG. 3 in that the ski boot is not shown;

Figure 1:
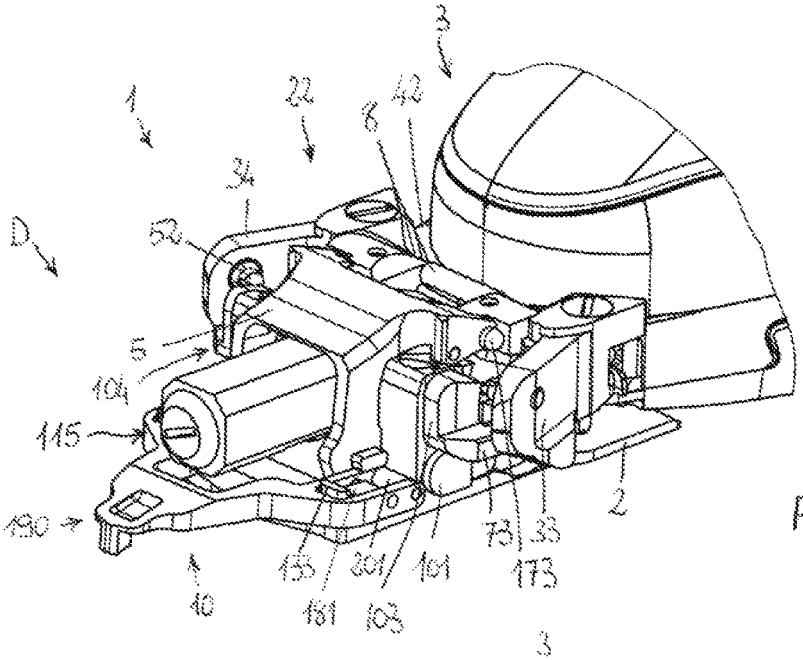
Figure 2:
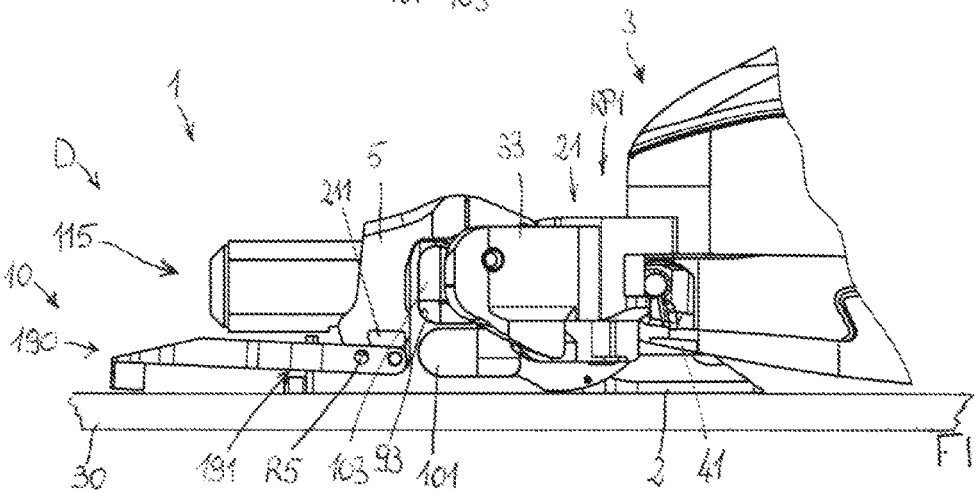
Figure 3:
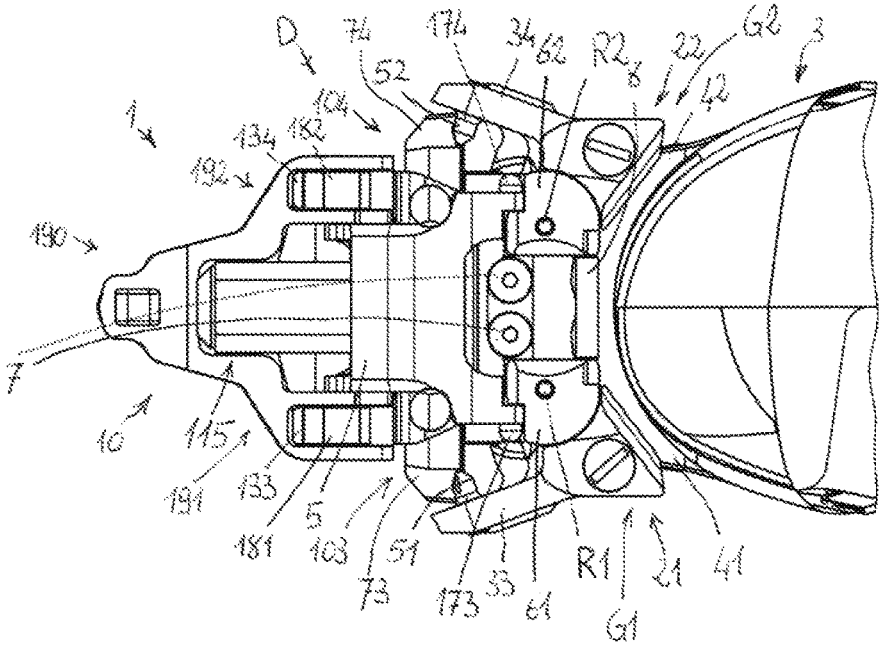
Figure 4:
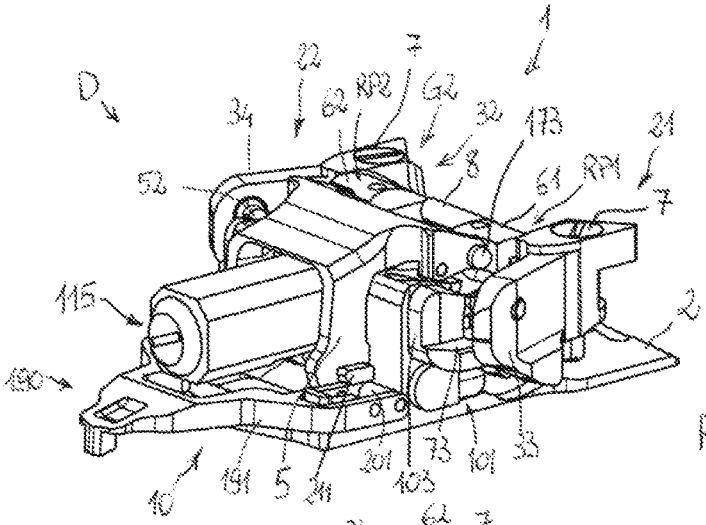
Figure 10:
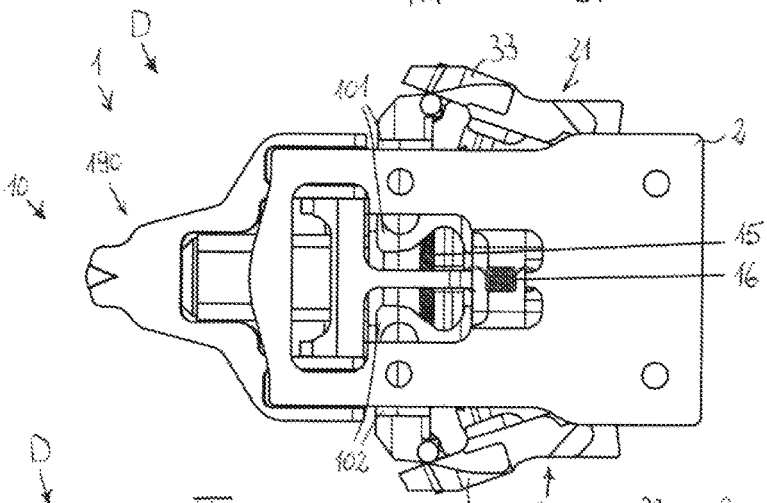
FIG. 10 is a view from below of the toe-piece of the ski binding of FIGS. 1-3.
Figure 11:
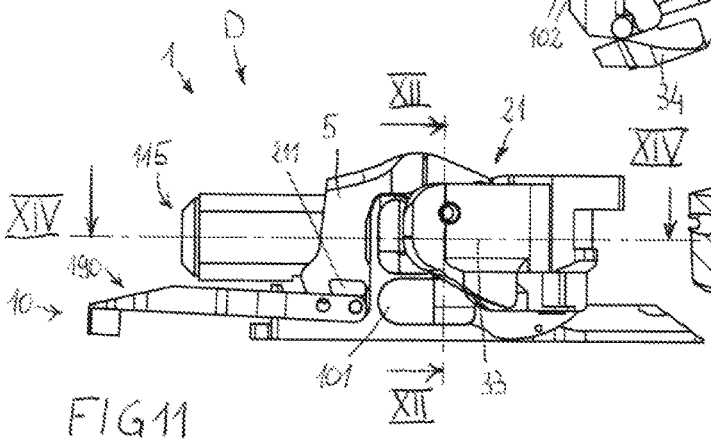
Figure 12:
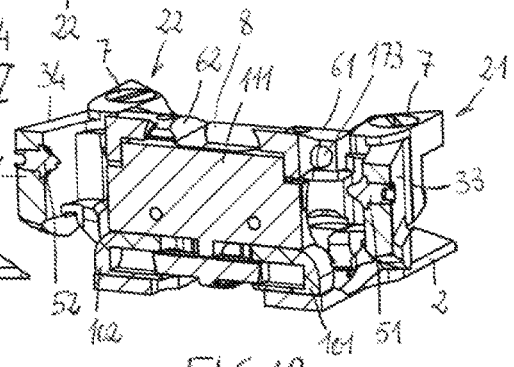
Figure 13:
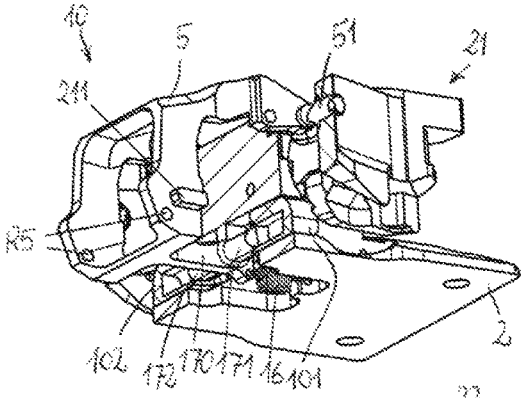
Figure 14:
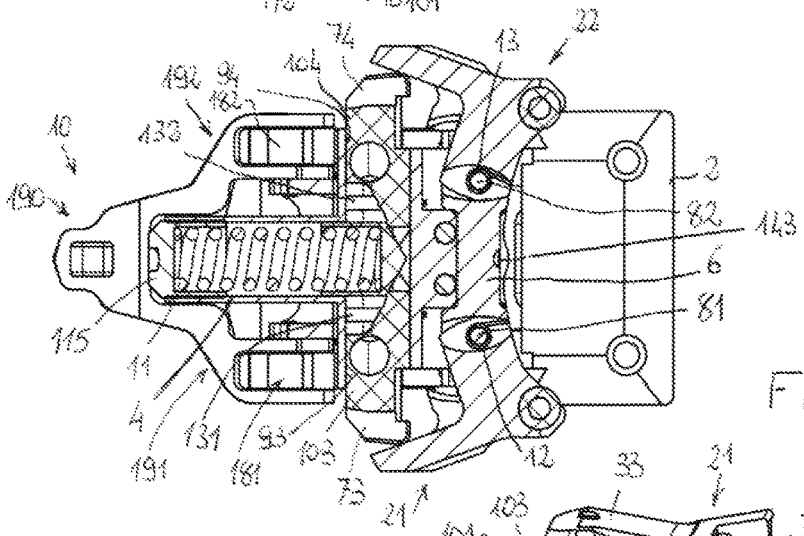
Figure 15:
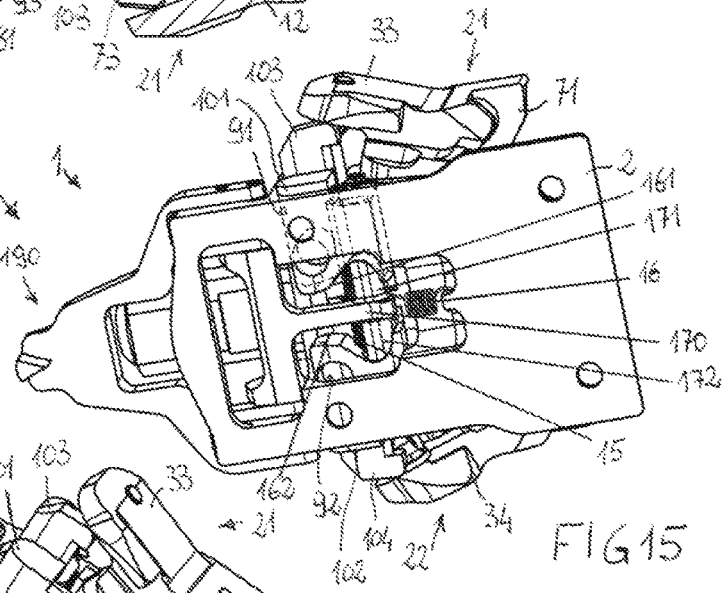
Figure 16:
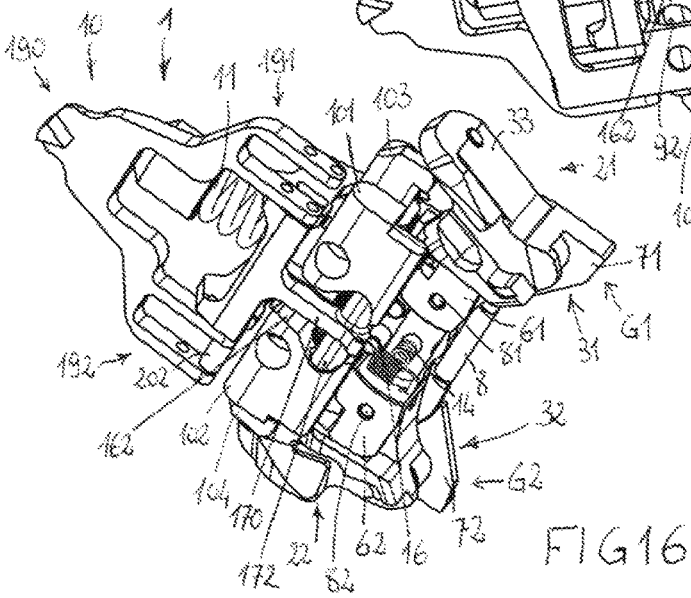
Figure 17:
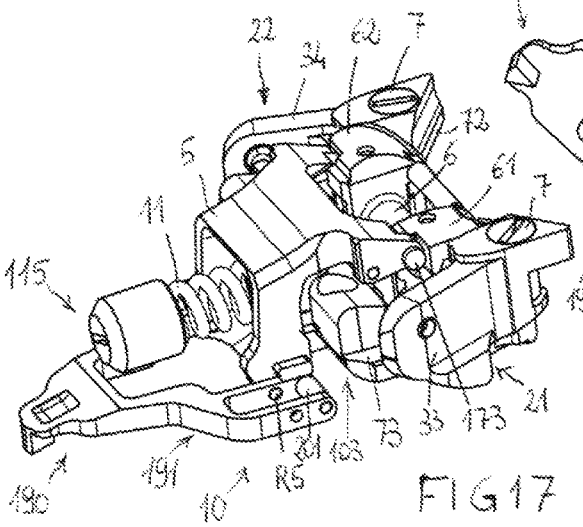
Figure 18:
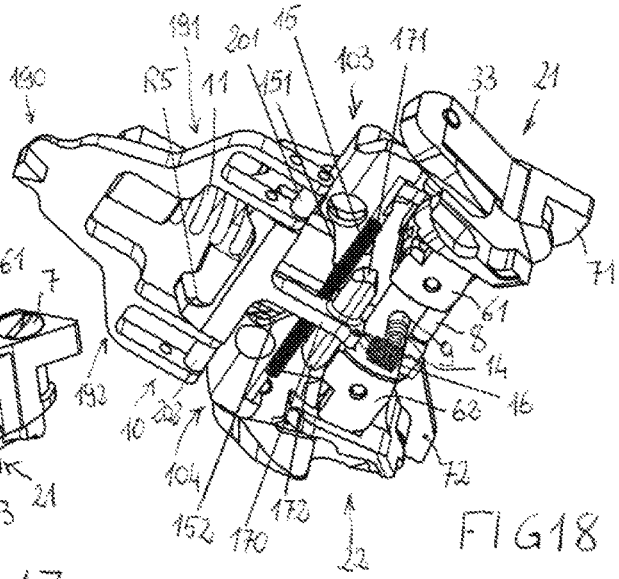
Figure 19:
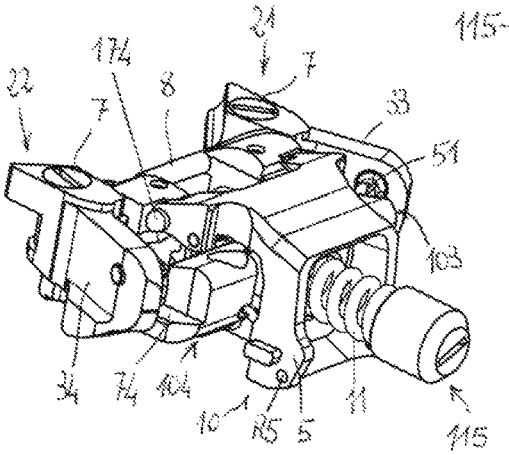
Figure 20:
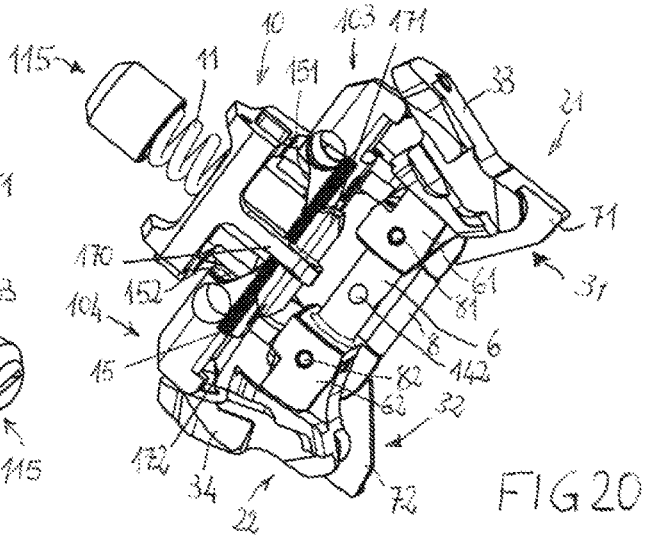
Figure 21:
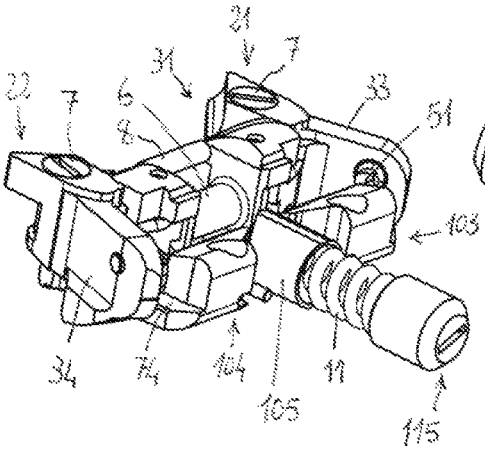
Figure 22:
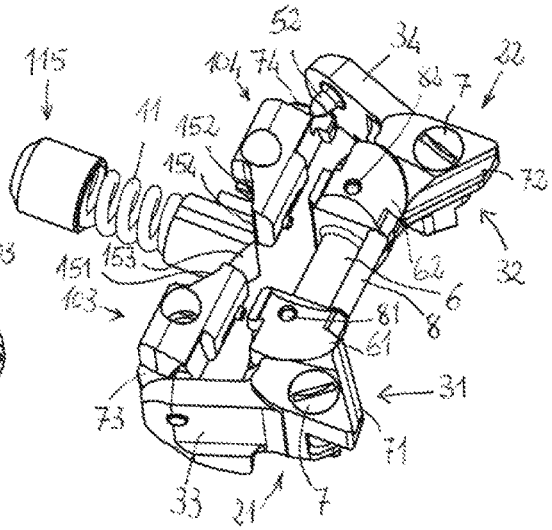
Figure 23:
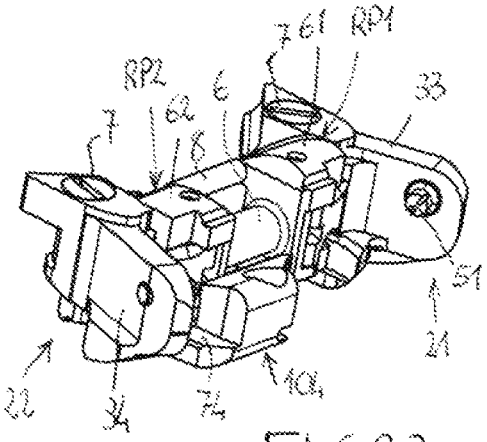
Figure 24:
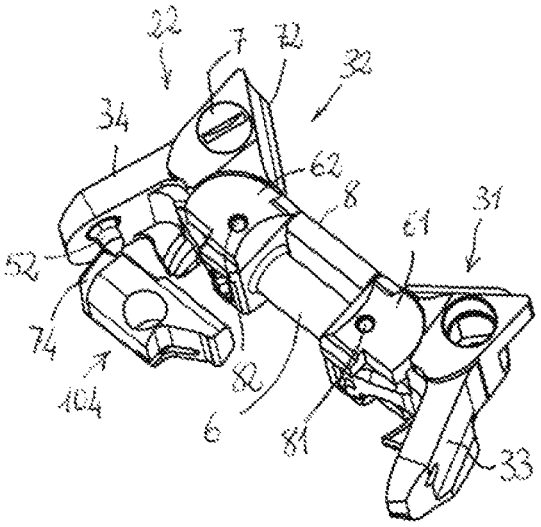
Figure 25:
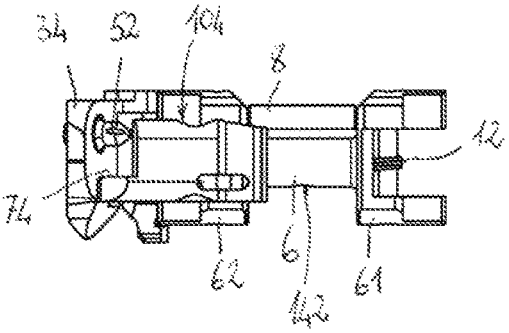
Figure 26:
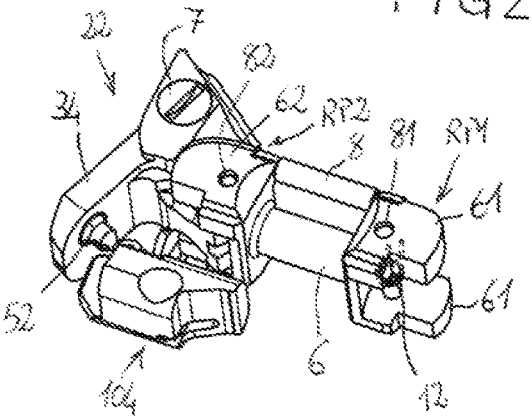
Figure 27:
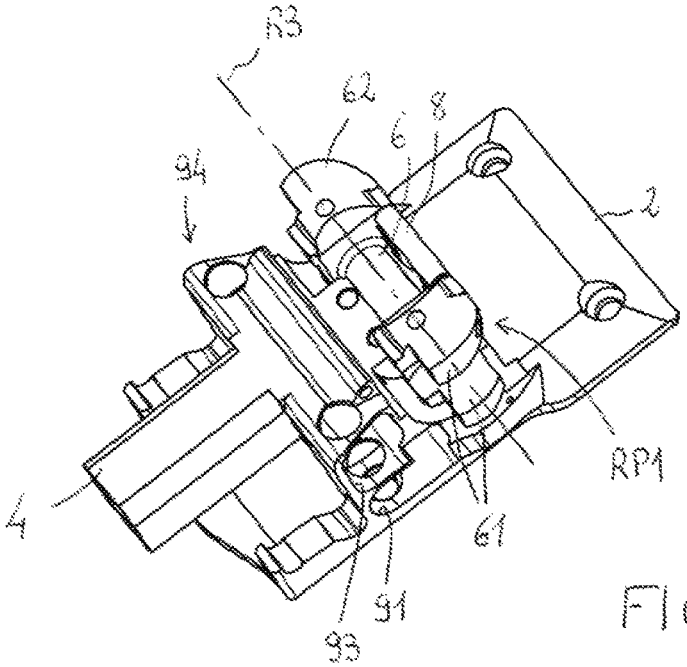
Figure 28:
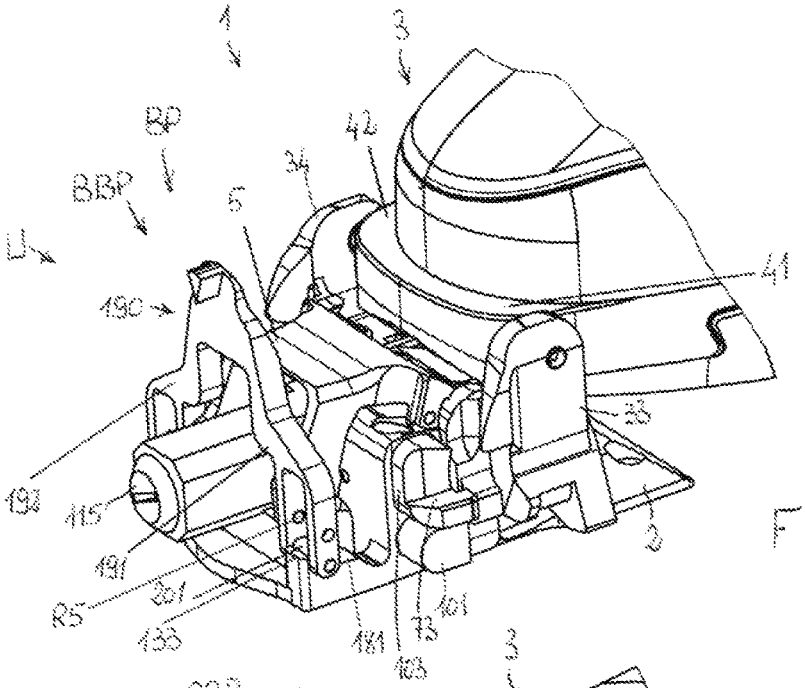
Figure 29:
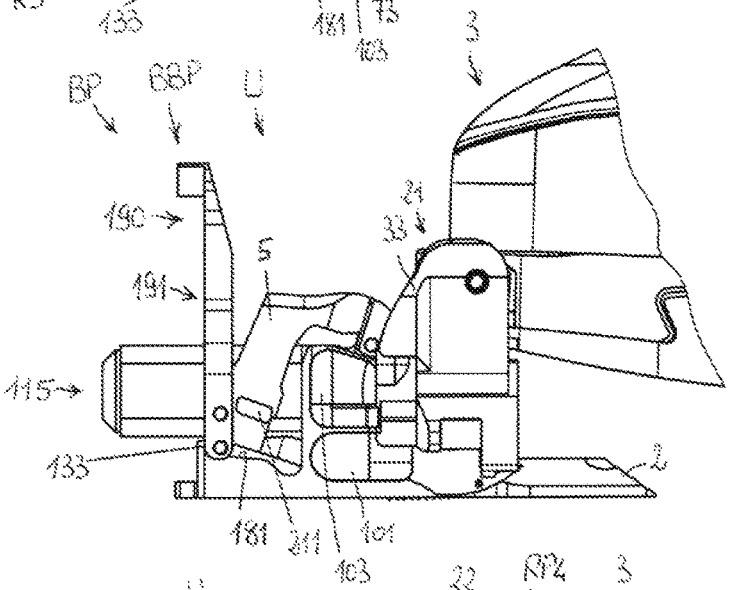
Figure 30:
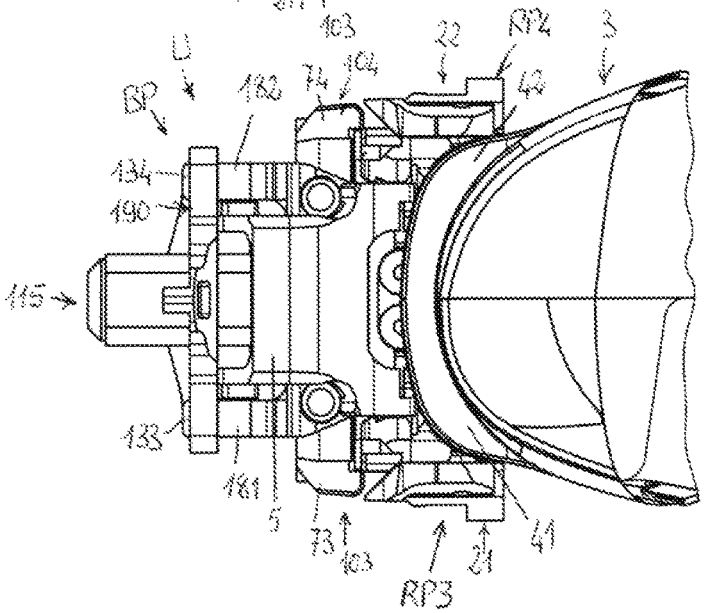
Figure 31:
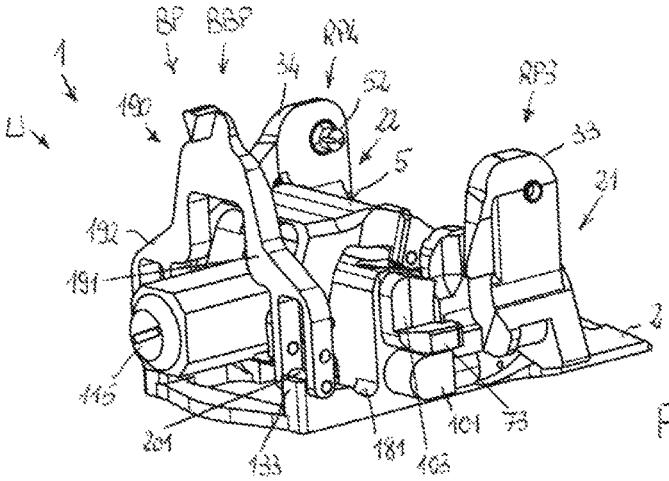
Figure 32:
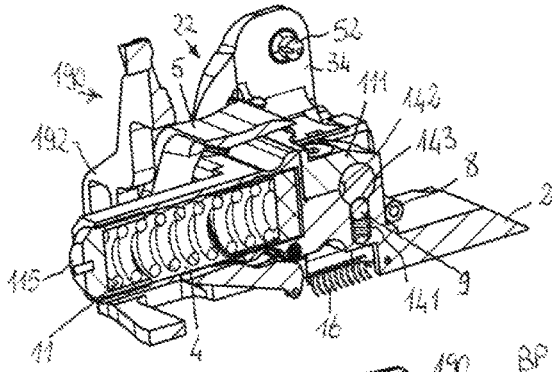
Figure 33:
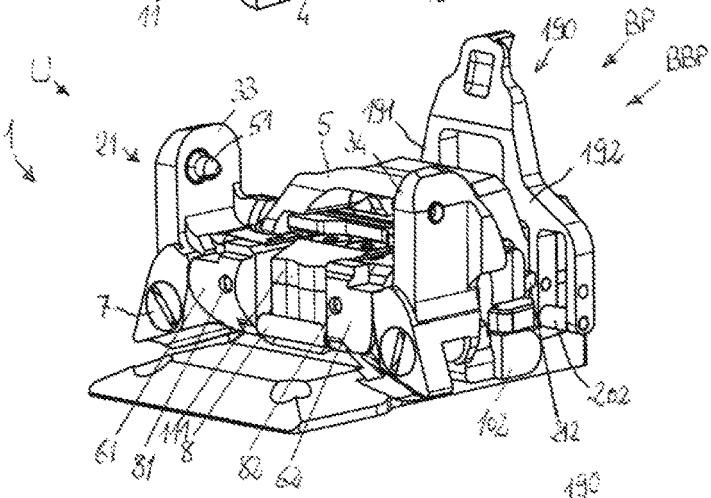
Figure 34:
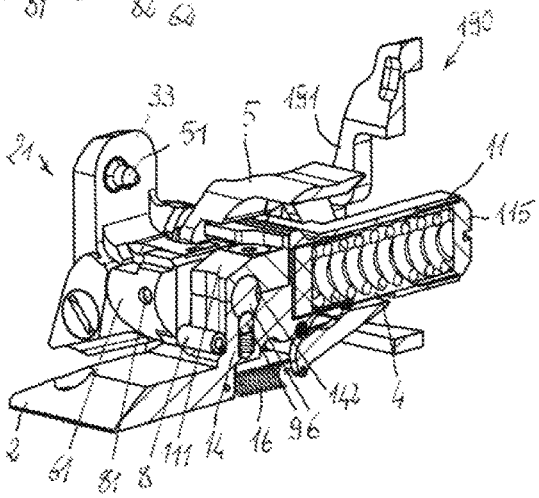
Figure 36:
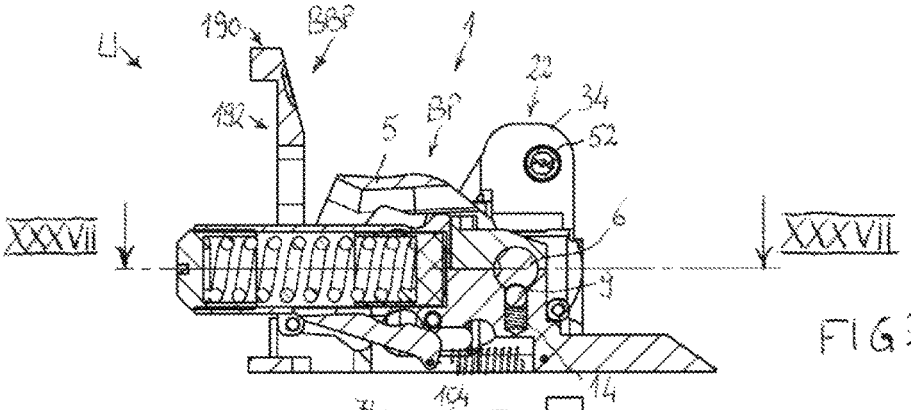
Figure 37:
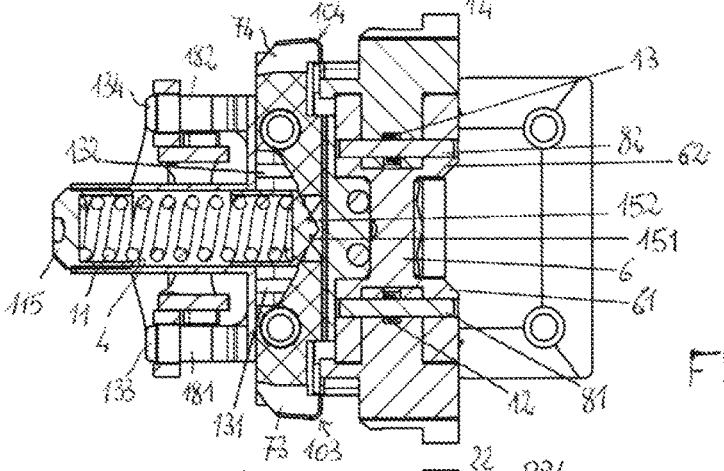
Figure 35:
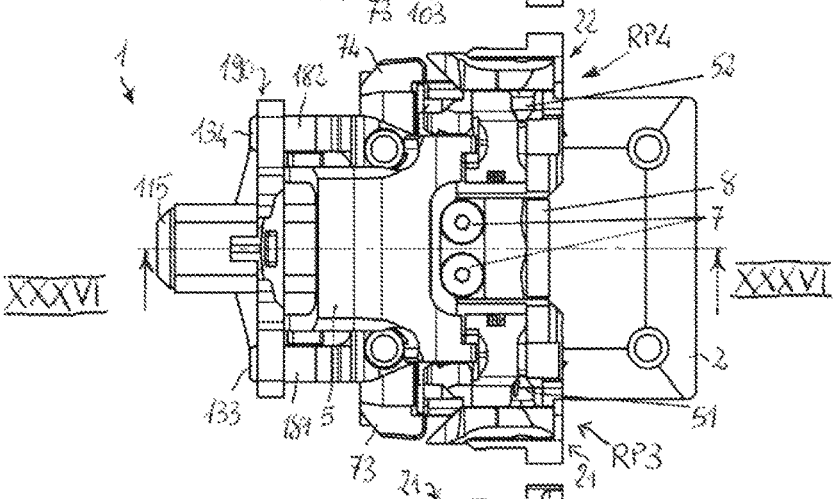
Figure 38:
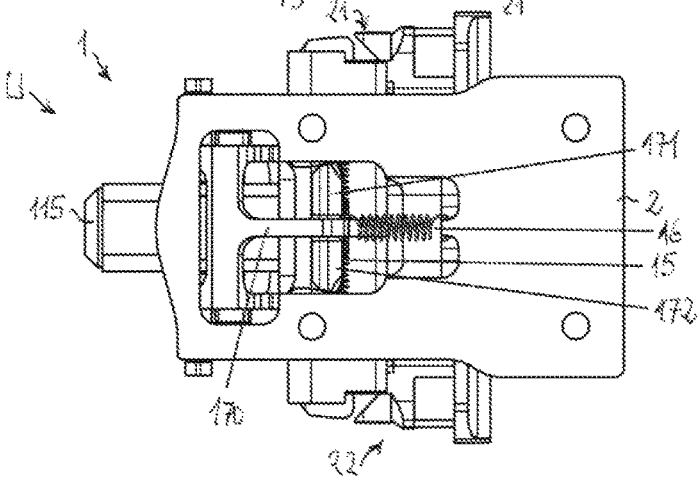
Figure 39:
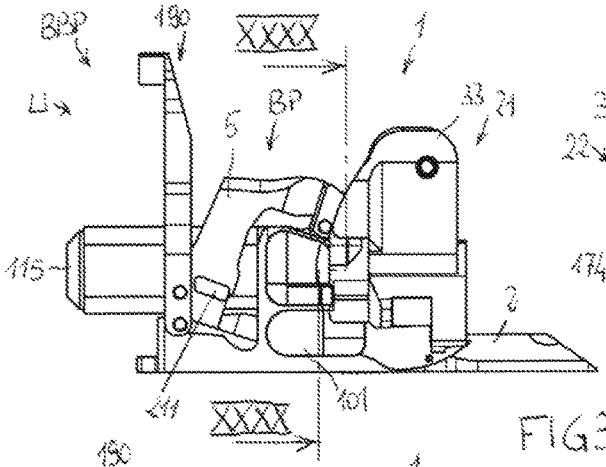
Figure 40:
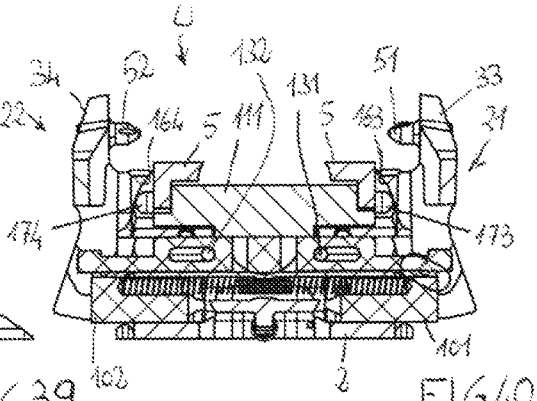
Figure 41:
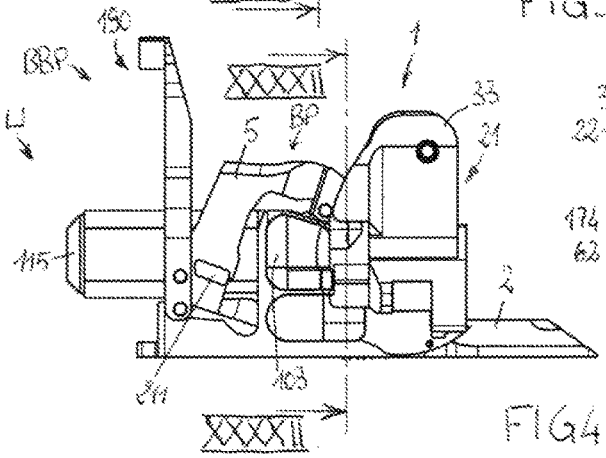
Figure 42:
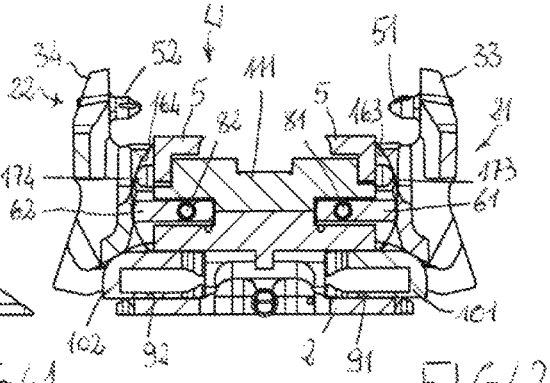
Figure 43:
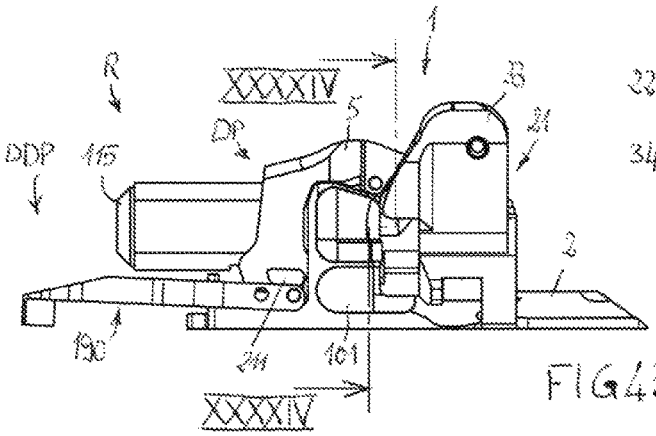
Figure 44:
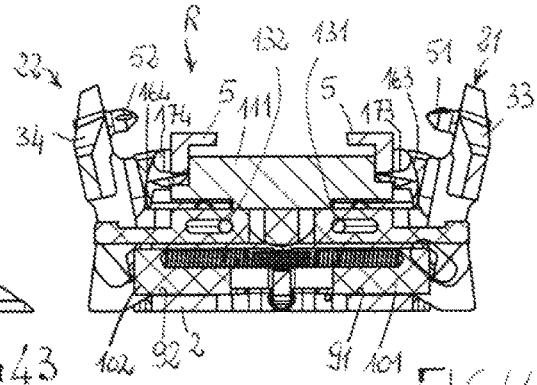
Figure 45:
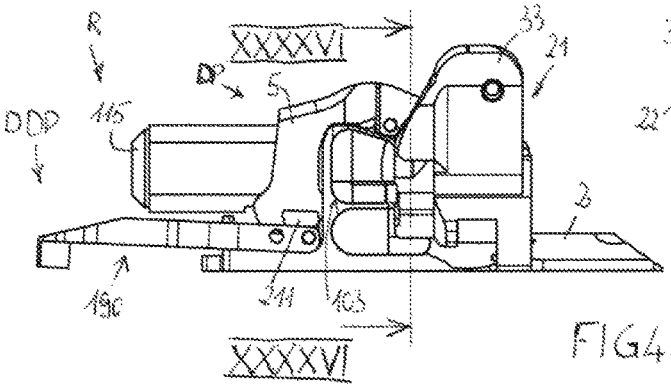
Figure 46:
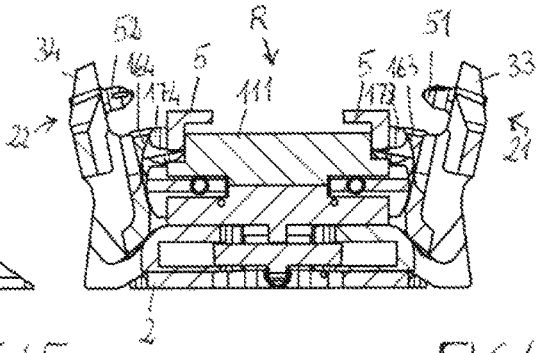
Figure 47:
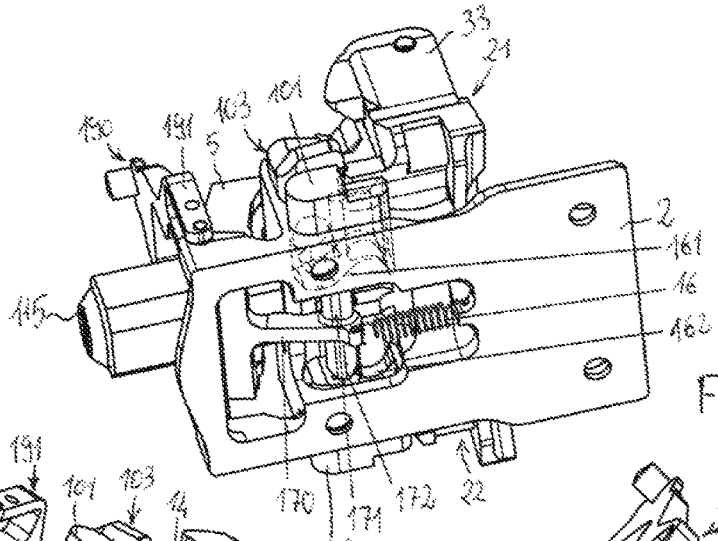
Figure 48:
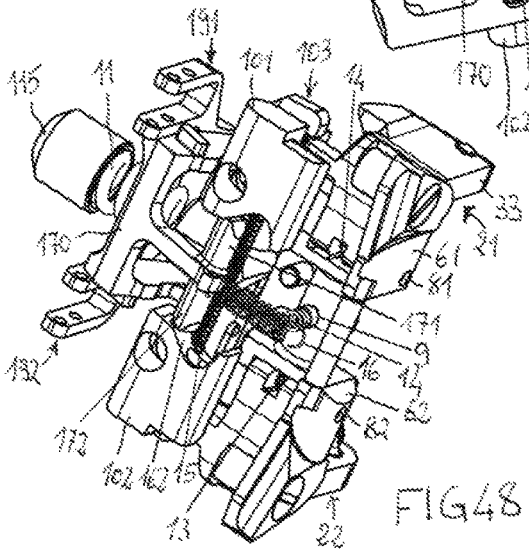
Figure 49:
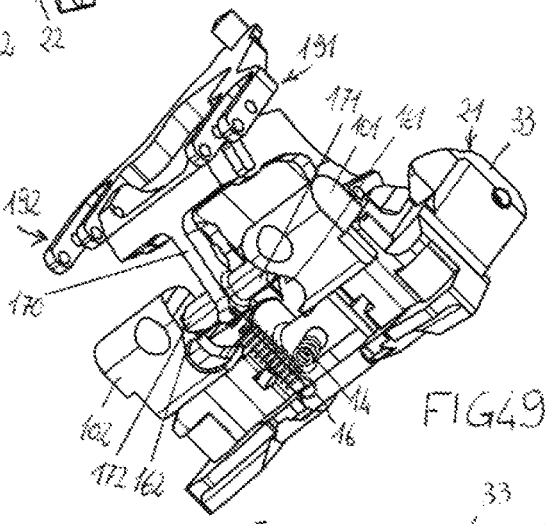
Figure 50:
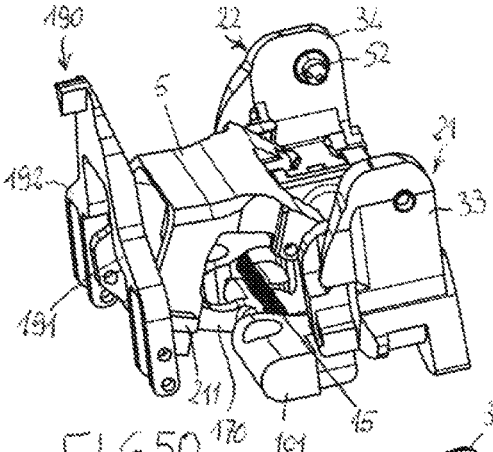
Figure 51:
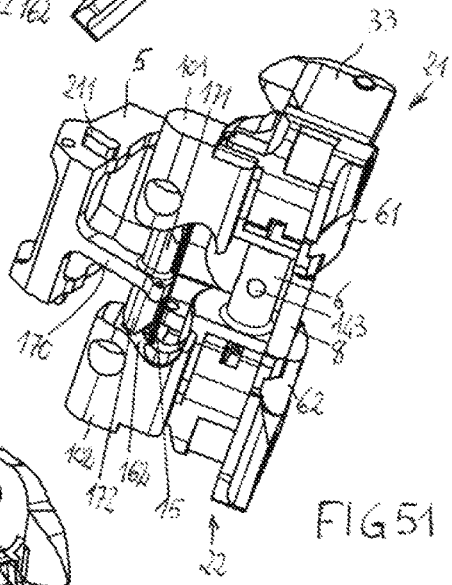
Figure 52:
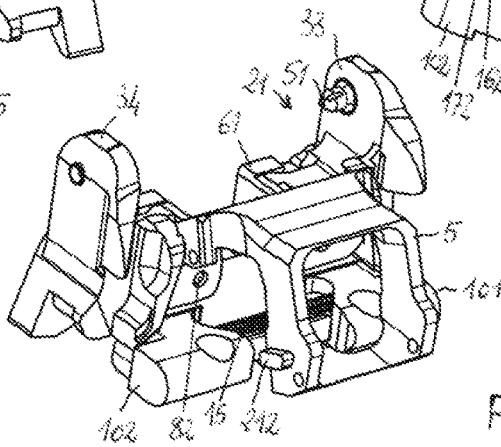
Figure 53:
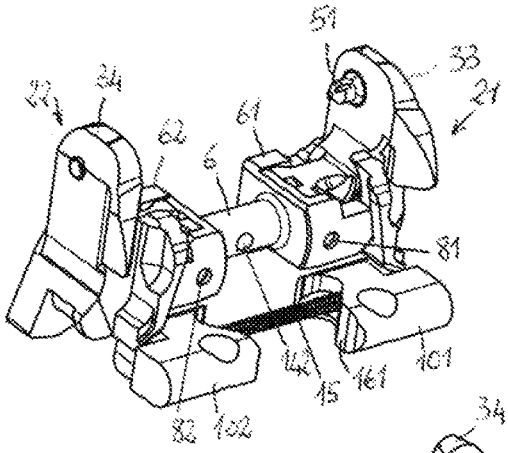
Figure 54:
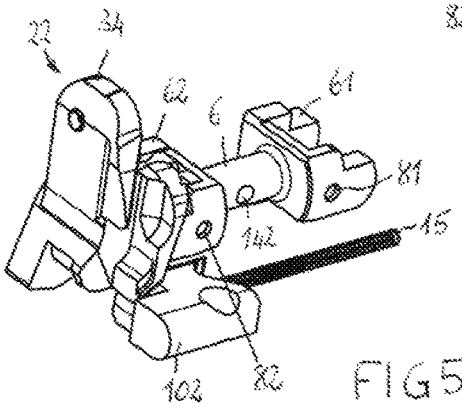
Figure 55:
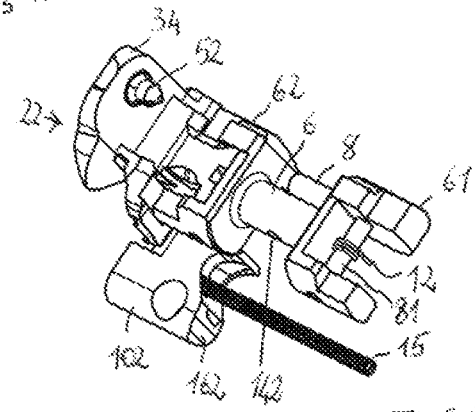
Figure 56:
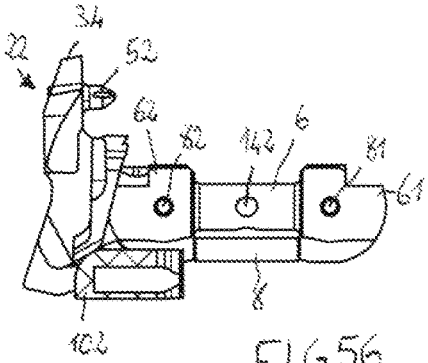
Figure 57:
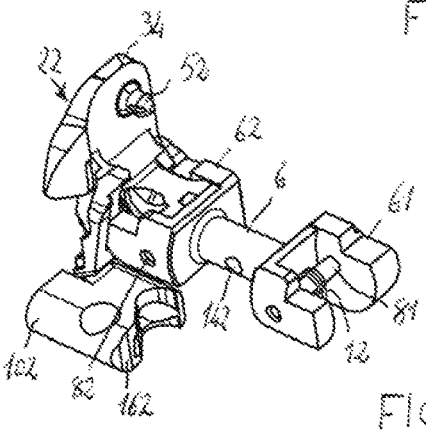
Figure 58:
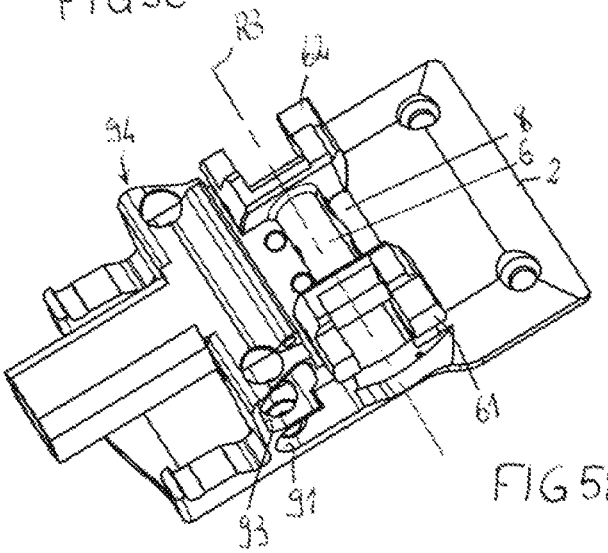
Figure 59:
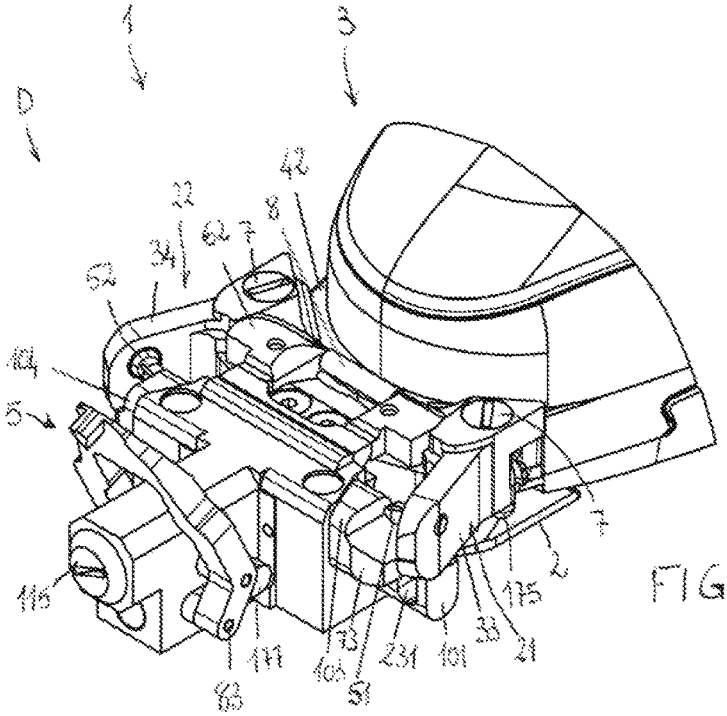
Figure 60:
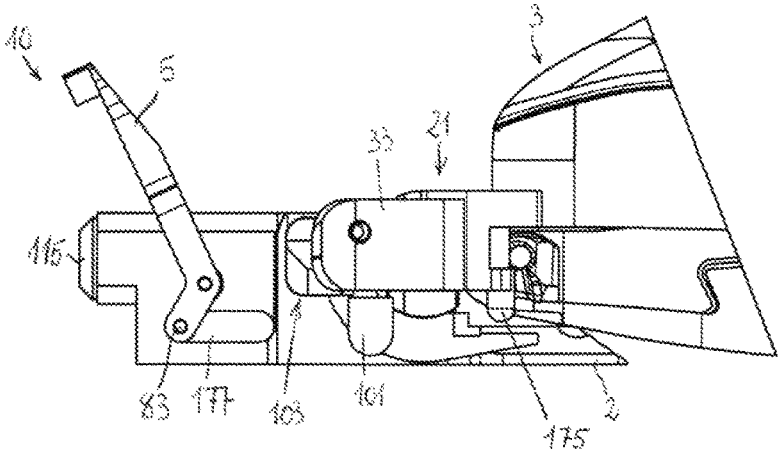
Figure 61:
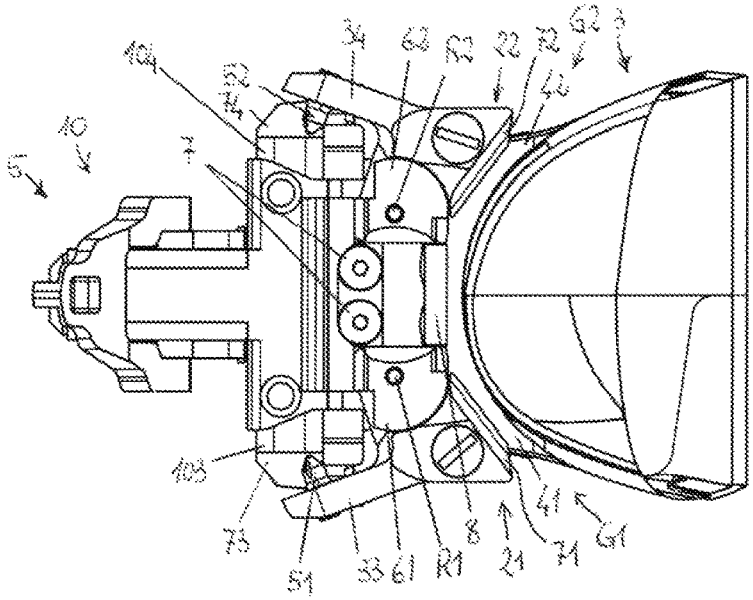
Figure 62:
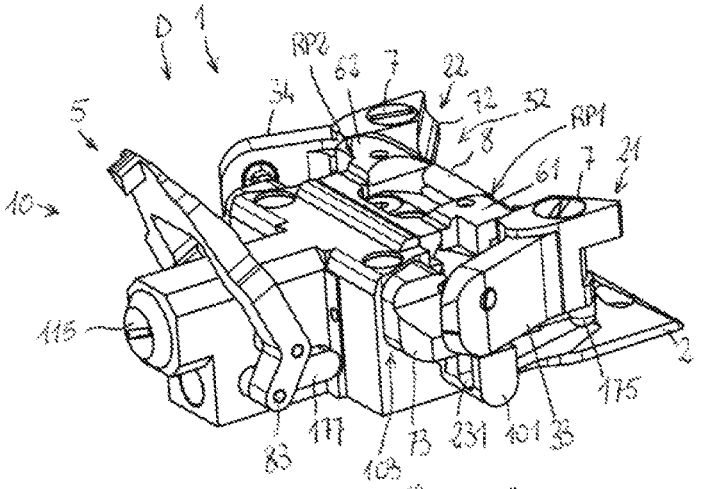
Figure 63:
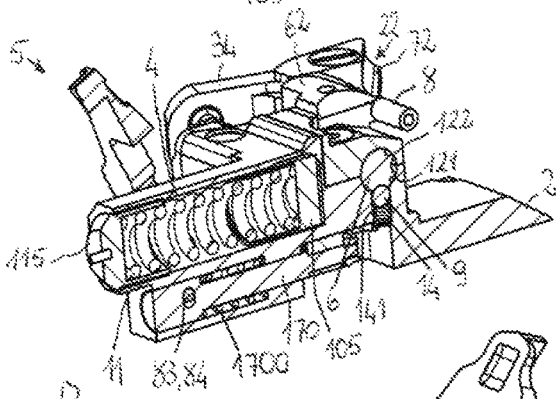
Figure 64:
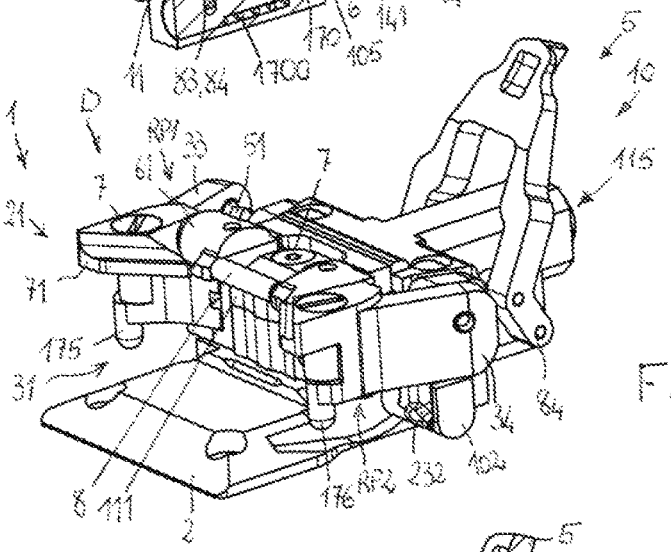
Figure 65:
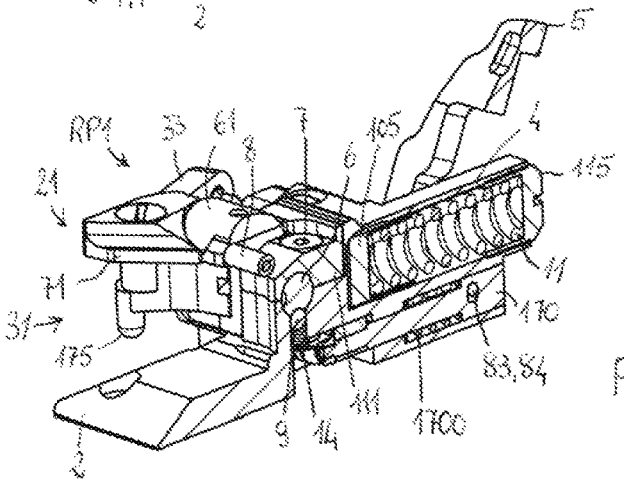
Figure 67:
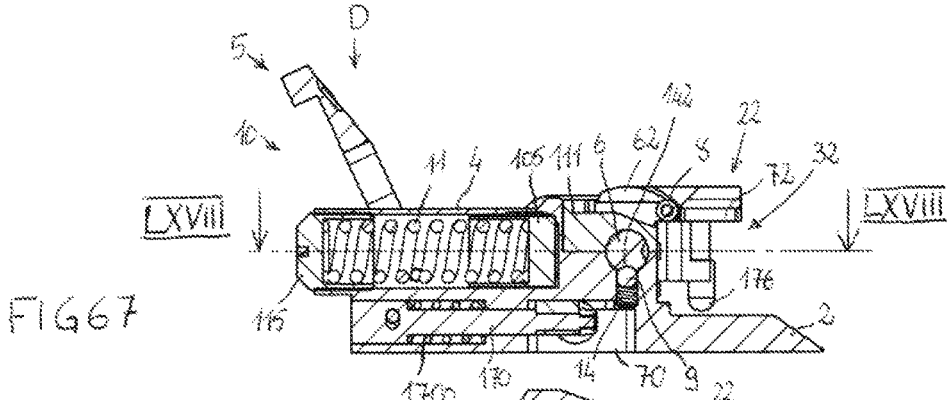
Figure 68:
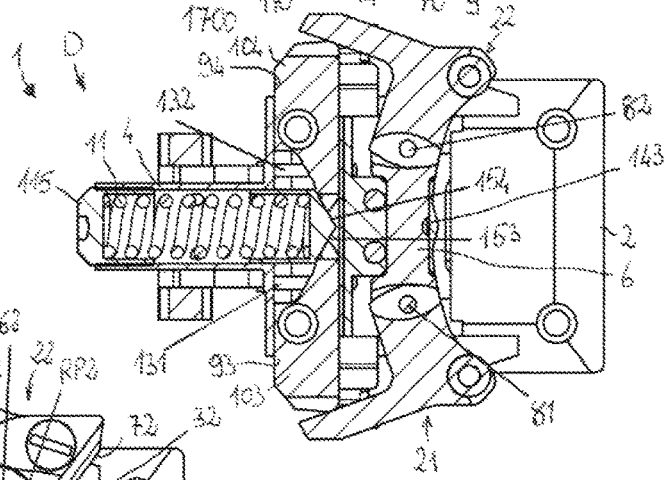
Figure 66:
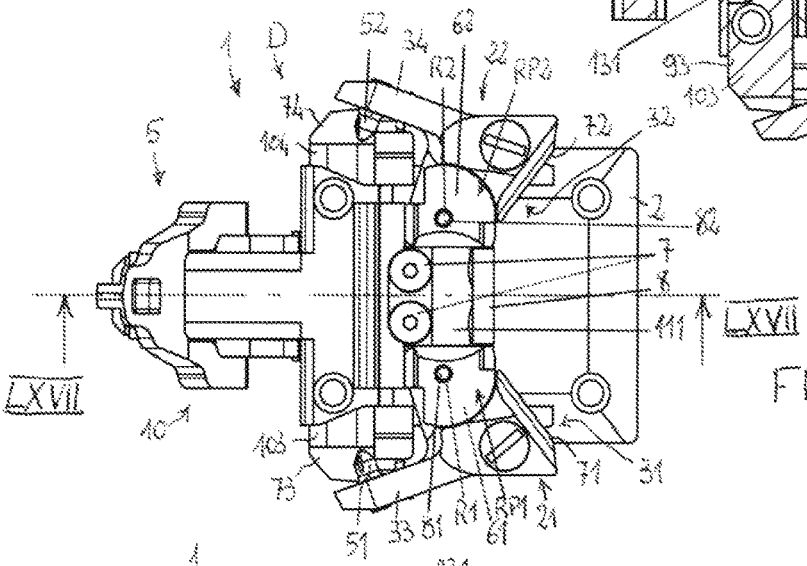
Figure 69:
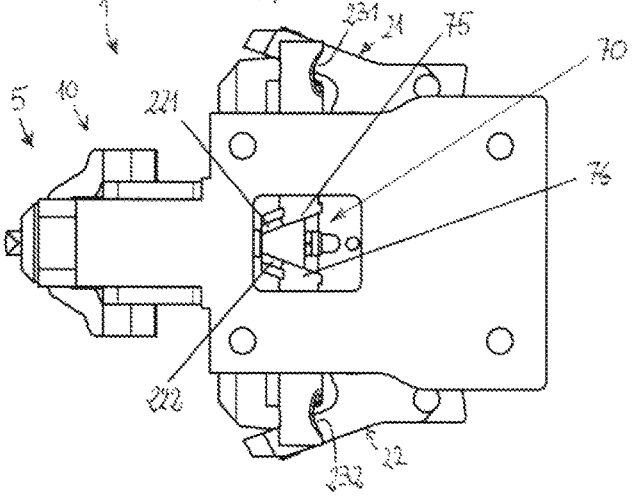
Figure 70:
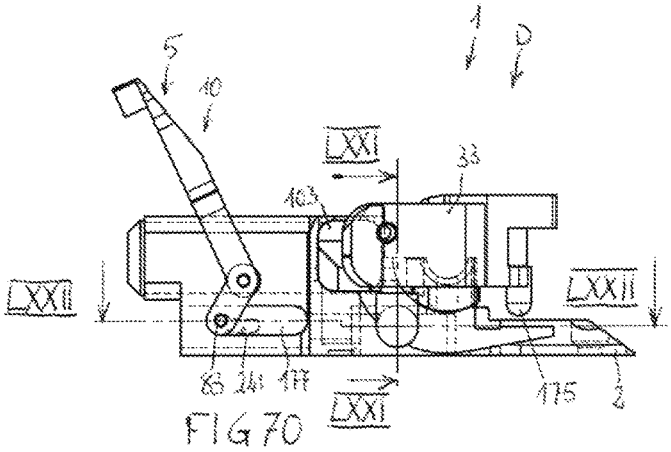
Figure 71:
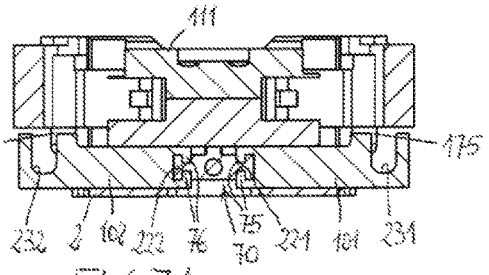
Figure 72:
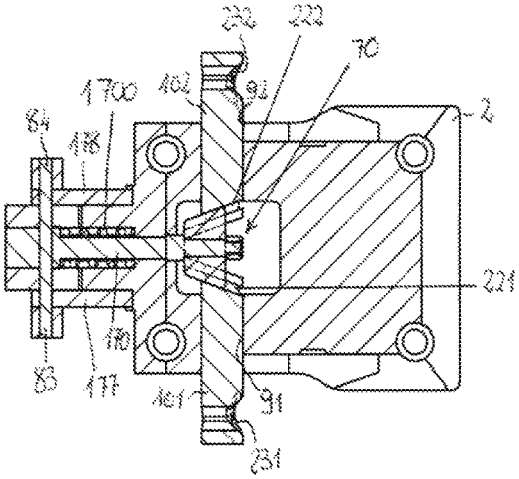
Figure 73:
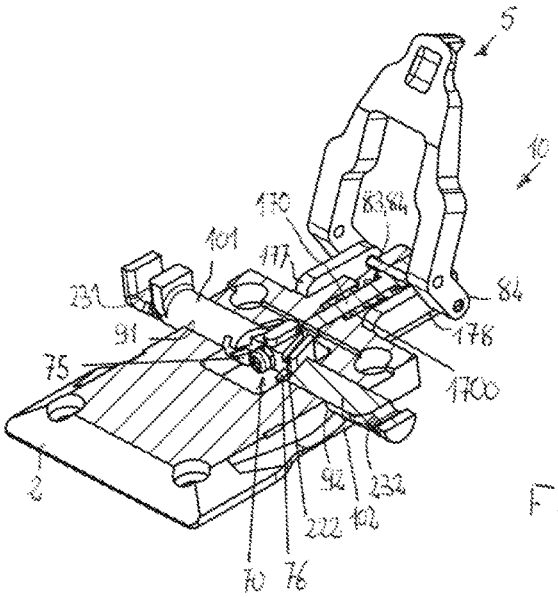
Figure 74:
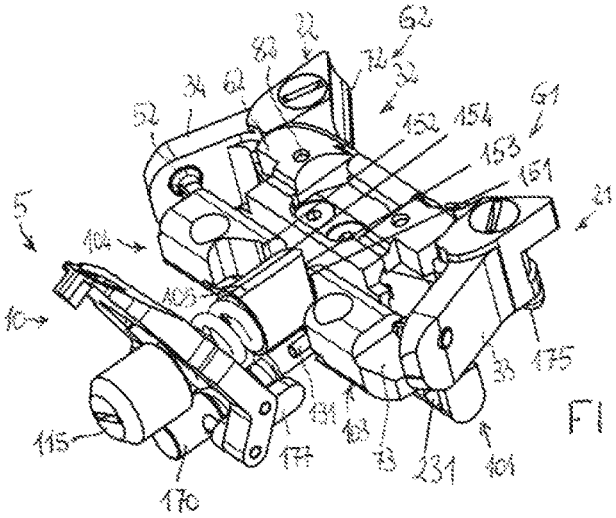
Figure 75:
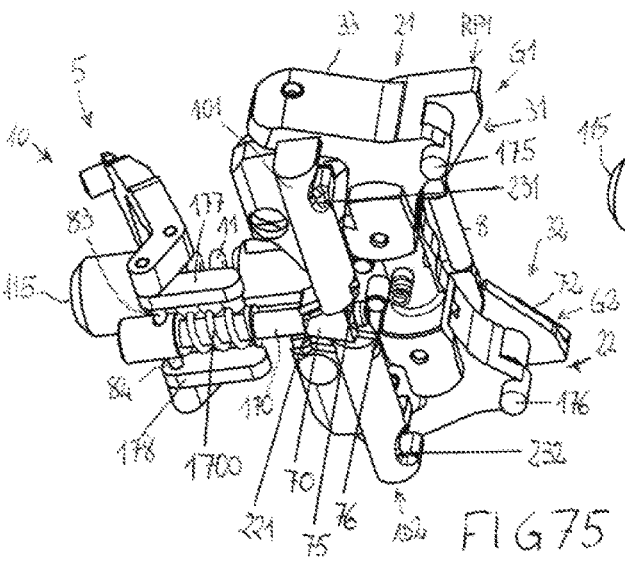
Figure 76:
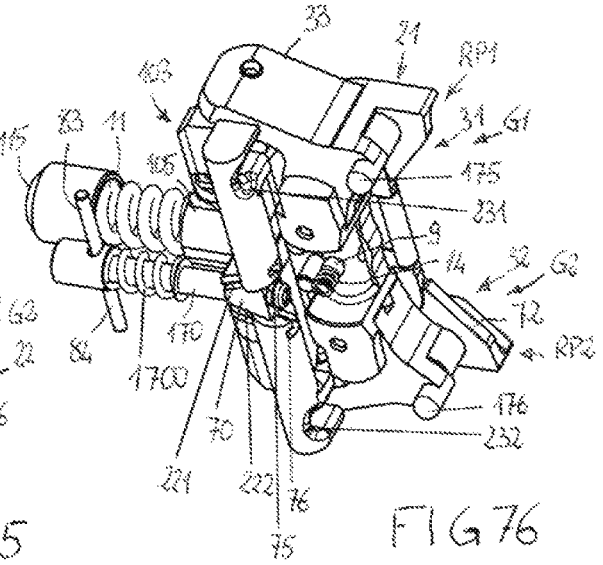
Figure 77:
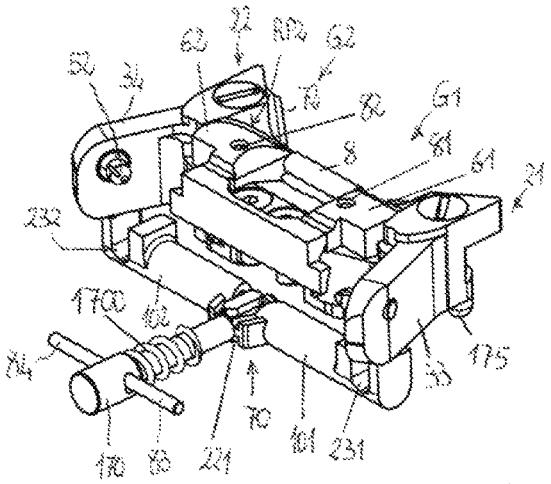
Figure 78:
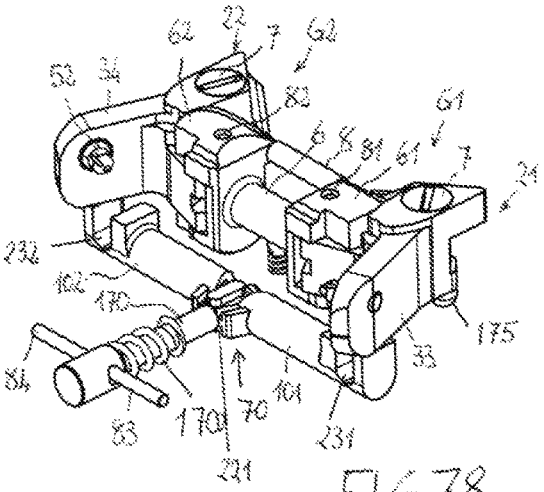
Figure 79:
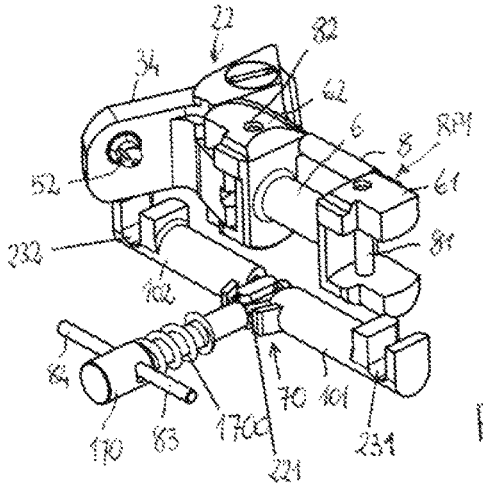
Figure 80:
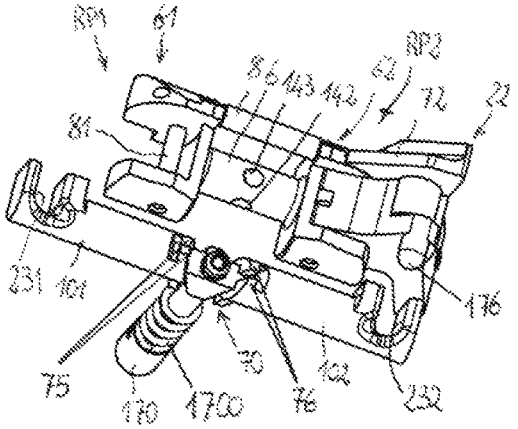
Figure 81:
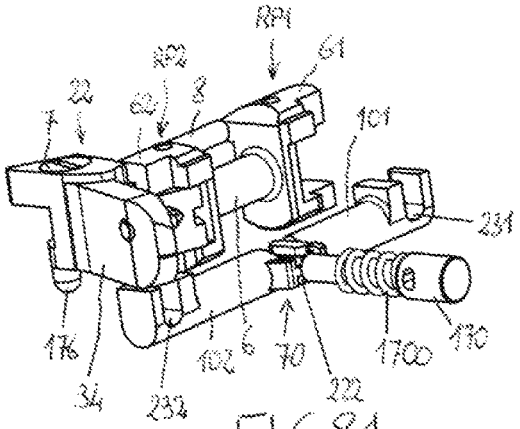
Figure 82:
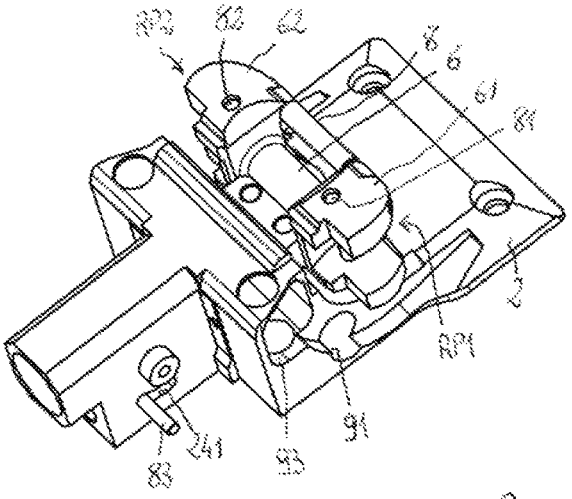
Figure 83:
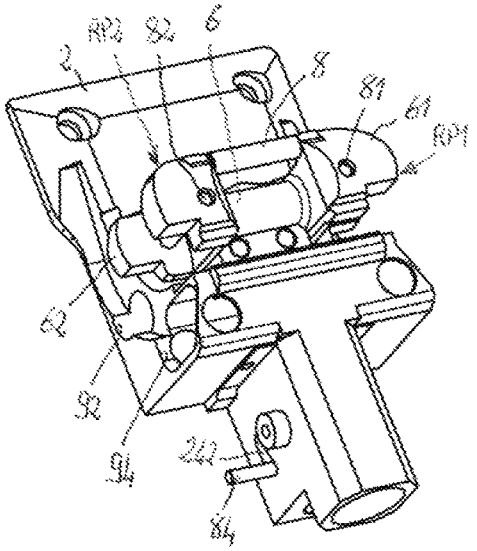
Figure 84:
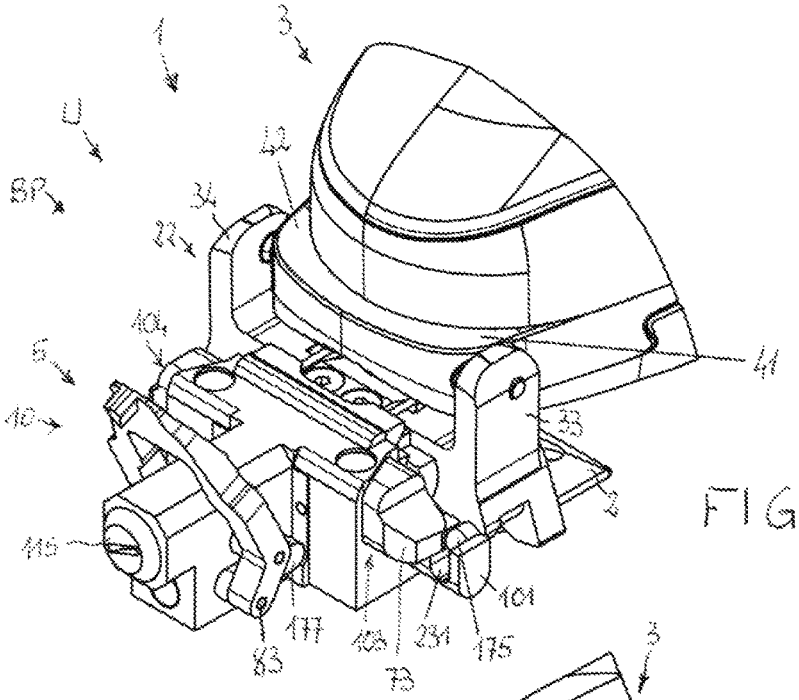
Figure 85:
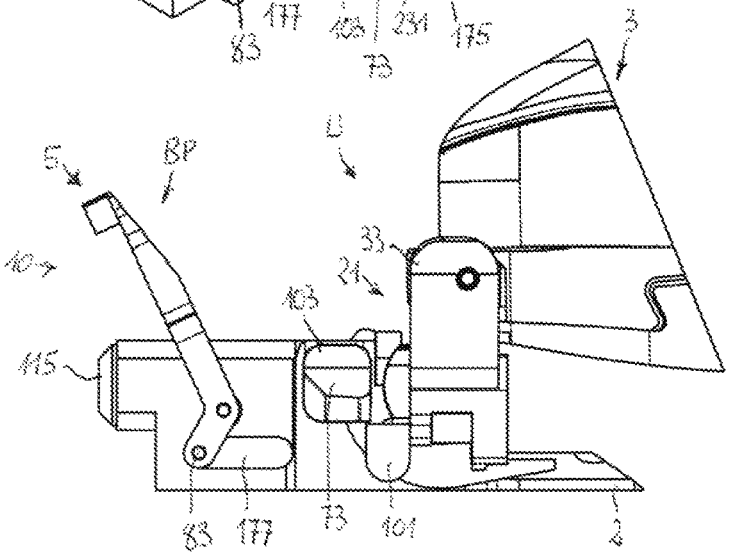
Figure 86:
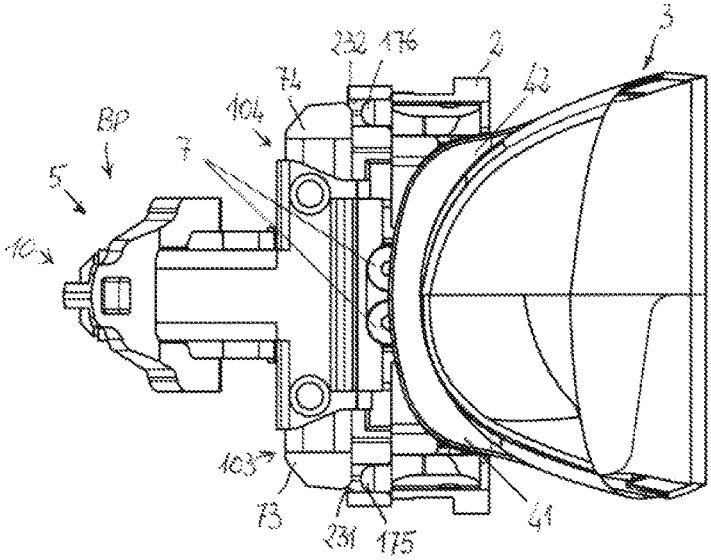
Figure 87:
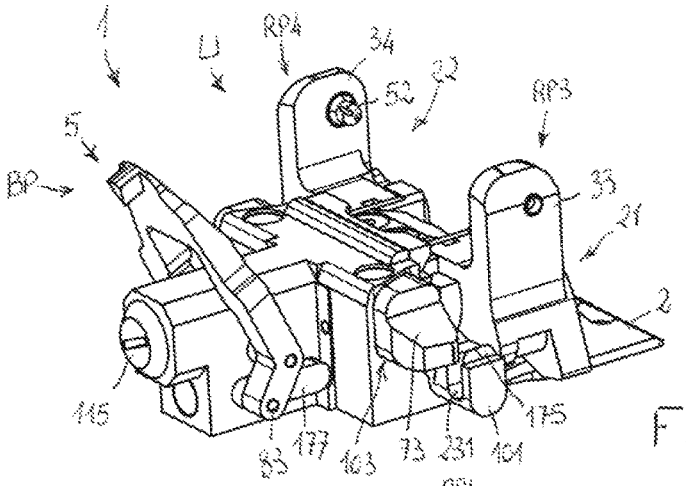
Figure 88:
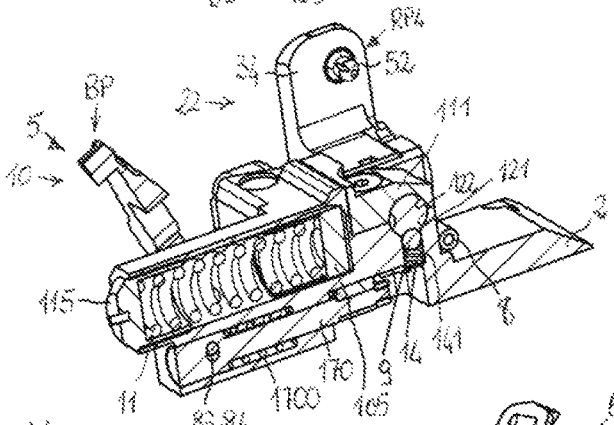
Figure 89:
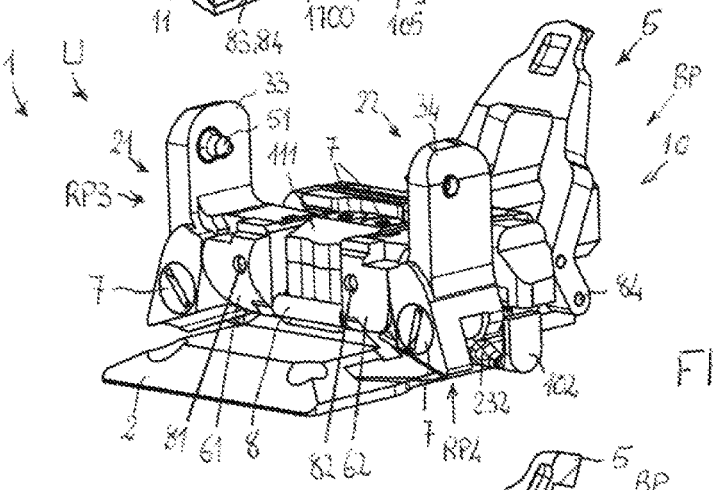
Figure 90:
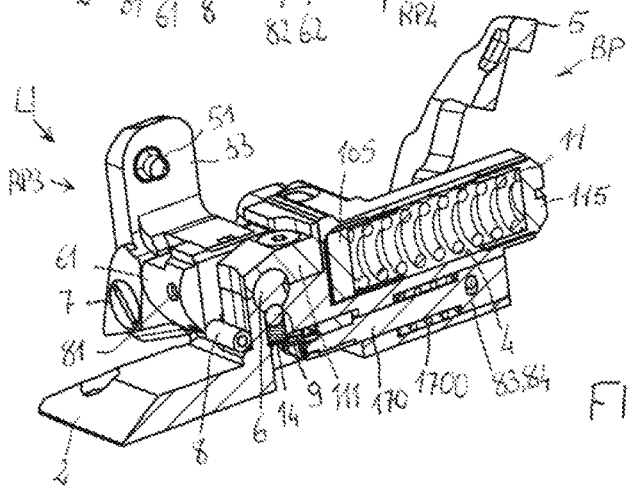
Figure 92:
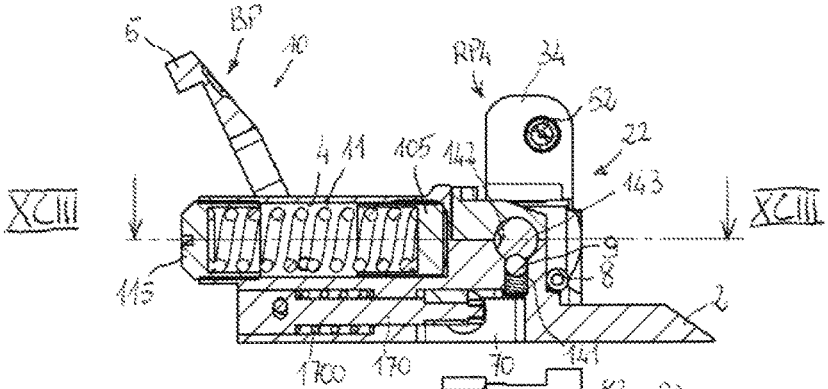
Figure 93:
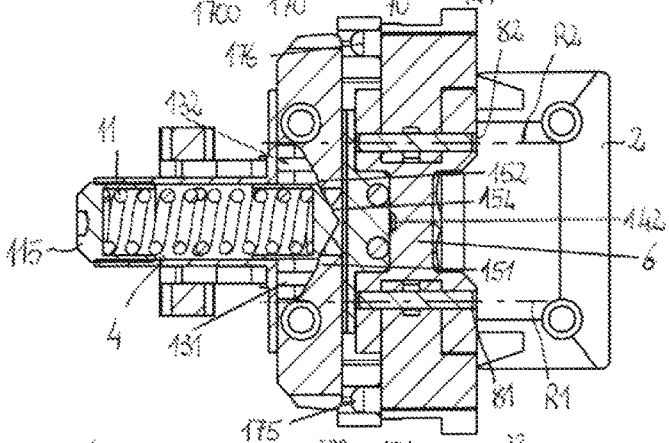
Figure 91:
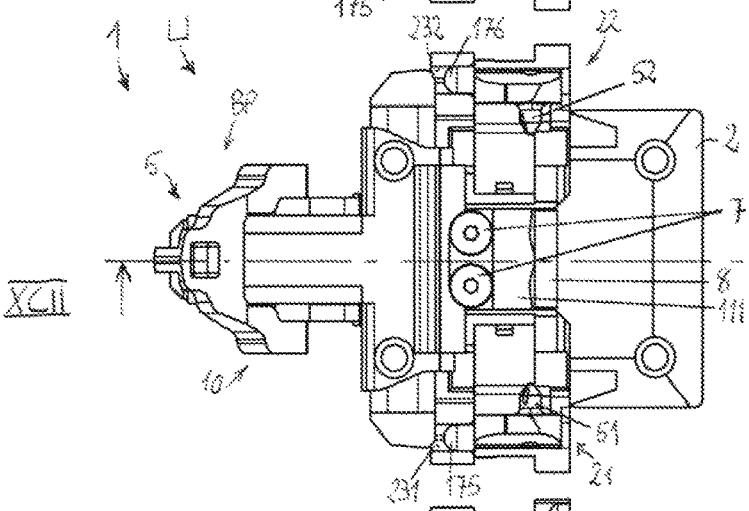
Figure 94:
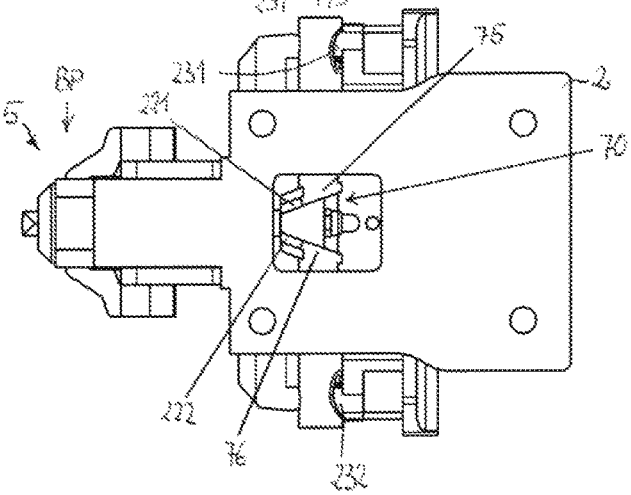
Figure 95:
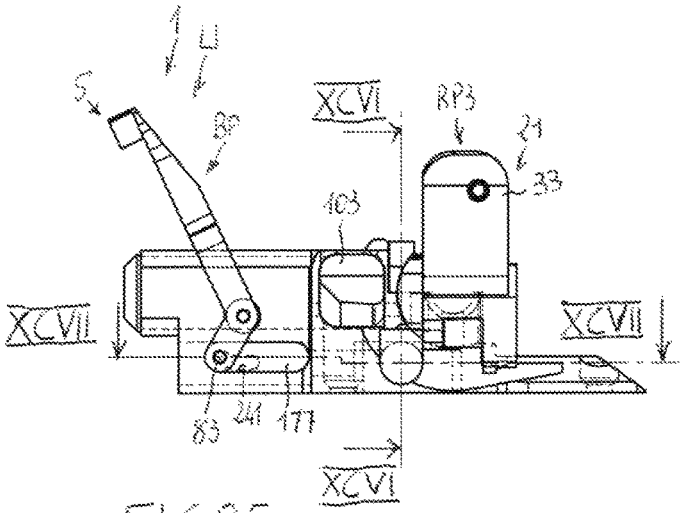
Figure 96:
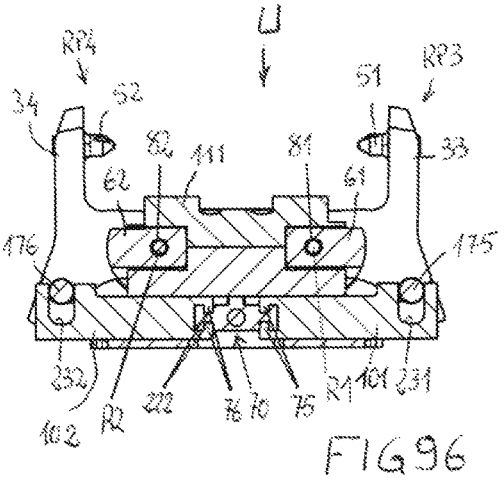
Figure 97:
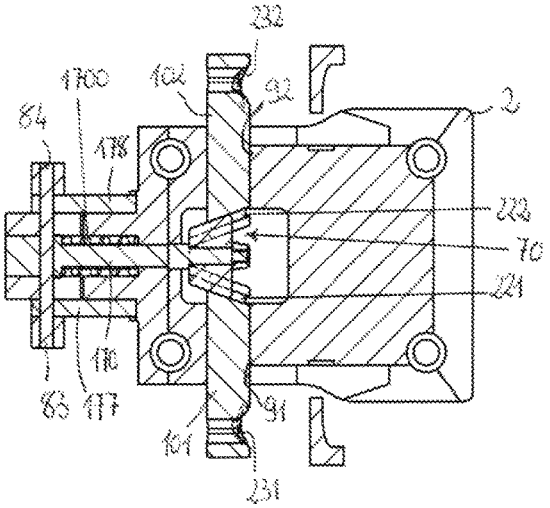
Figure 98:
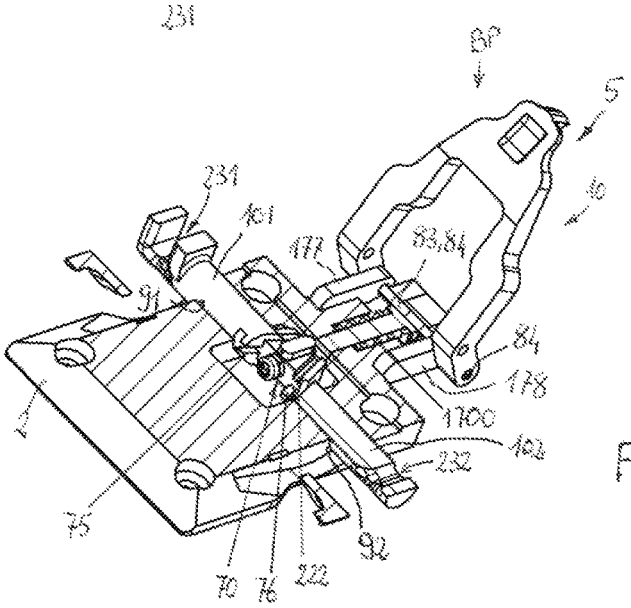
Figure 103:
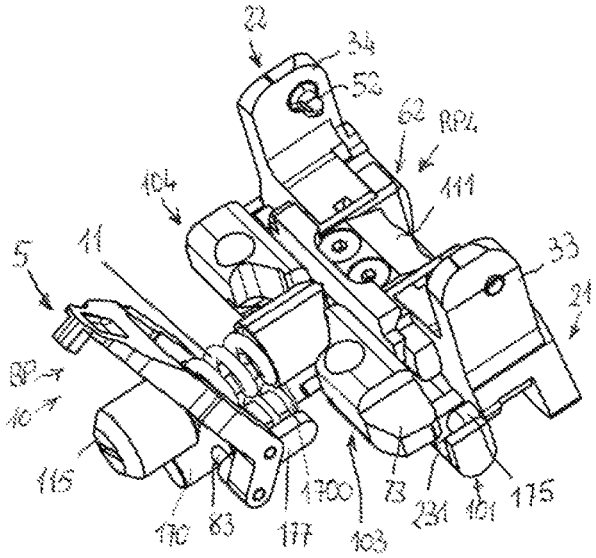
Figure 104:
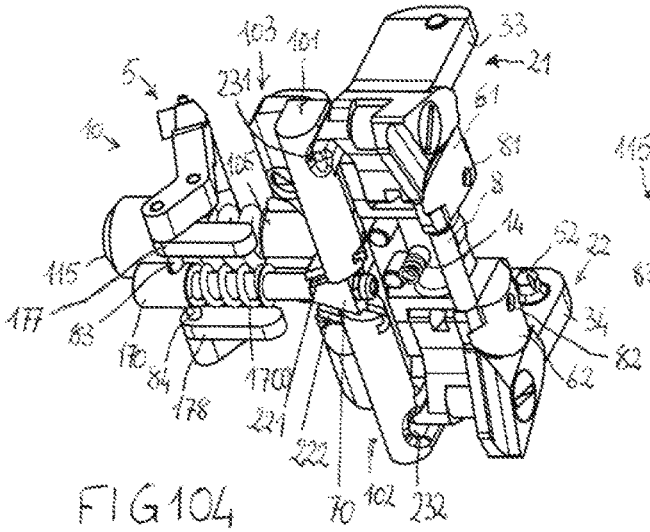
Figure 105:
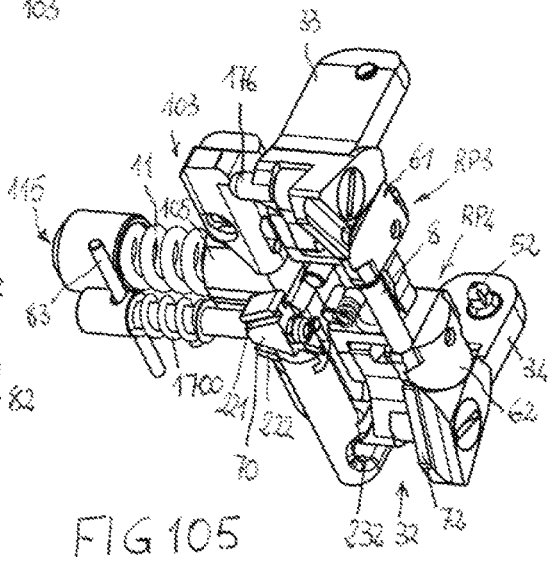
Figure 106:
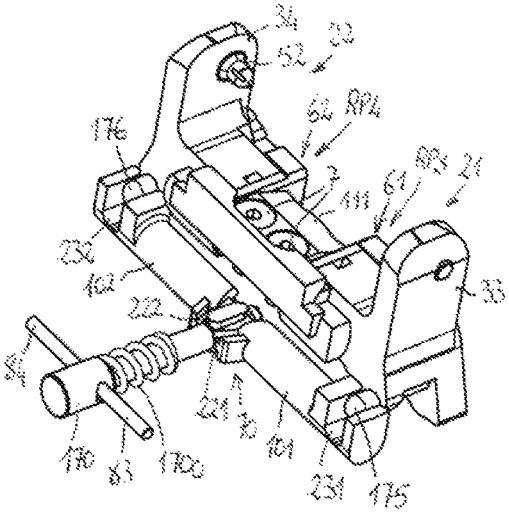
Figure 107:
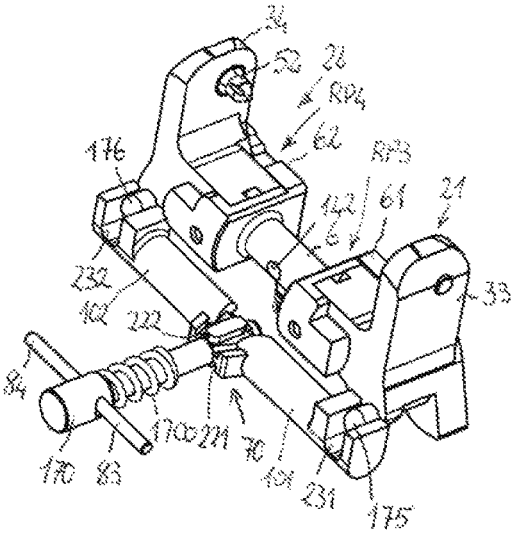
Figure 108:
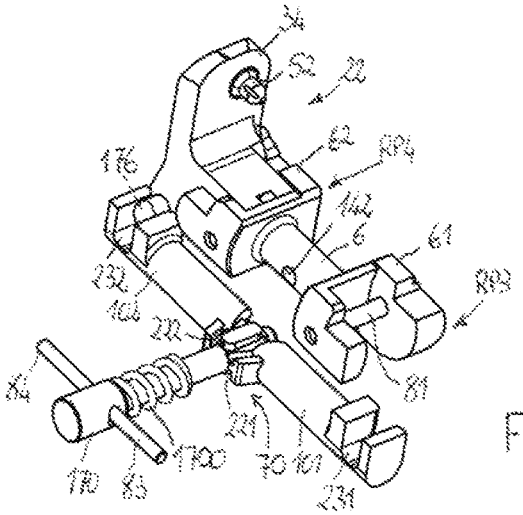
Figure 109:
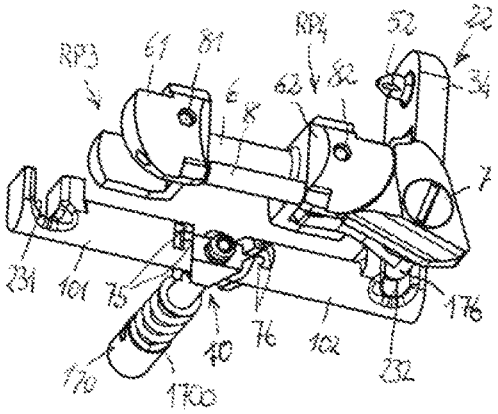
Figure 110:
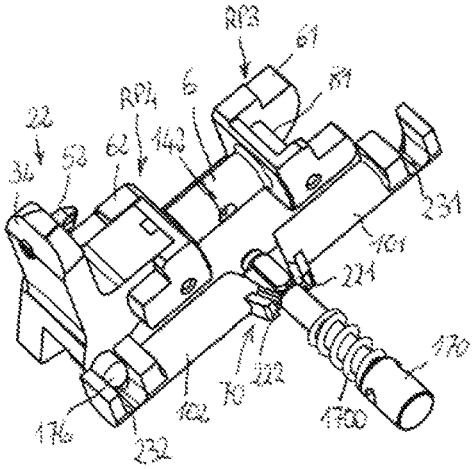
Figure 111:
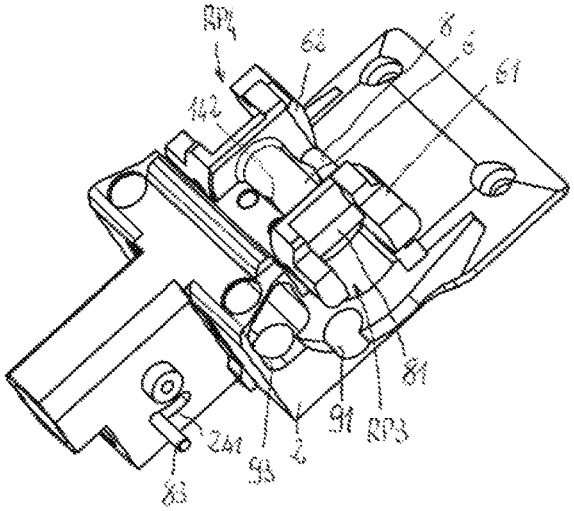
Figure 112:
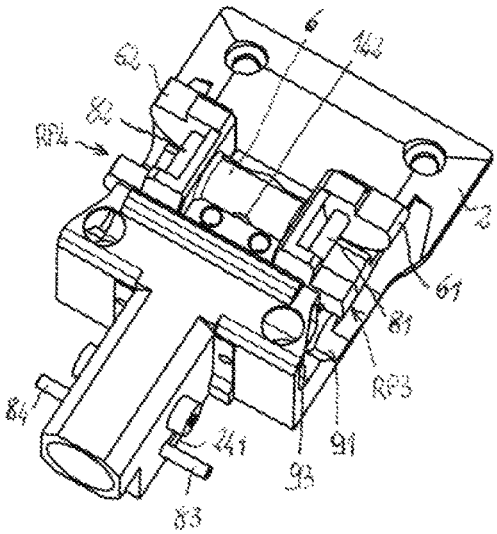

FIG. 11 differs from FIG. 2 in that the ski boot is not shown;

FIG. 12 is a view according to section plane XII-XII of FIG. 11, but in perspective view;

FIG. 13 is alike FIG. 12, with the difference that it is taken from a different angle and in that additional characteristics are shown which in section XII-XII would not have been visible;

FIG. 14 is a view according to section plane XIV-XIV of FIG. 11;

FIG. 15 is a view from below of the toe-piece of the ski binding of FIGS. 1-3, alike to FIG. 10 but in perspective view;

FIG. 16 is alike FIG. 15, with the difference that it is taken from a different angle and in that the base has been omitted;

FIGS. 17, 18 are two perspective views alike to FIG. 16, with the difference that they are taken from different angles and that further components have been omitted;

FIGS. 19, 20 are two perspective views alike to FIGS. 17 and 18, with the difference that they are taken from different angles and that further components have been omitted;

FIGS. 21, 22 are two perspective views alike to FIGS. 19 and 20, with the difference that they are taken from different angles and that further components have been omitted;

FIGS. 23, 24 are two perspective views alike to FIGS. 21 and 22, with the difference that they are taken from different angles and that further components have been omitted;

FIGS. 25, 26 are a frontal view and a perspective view, in which, with respect to FIGS. 23 and 24, further components have been omitted;

FIG. 27 is a perspective view from below of the toe-piece of a downhill ski binding of FIGS. 1-3, showing only the base, a first rotatable support and second rotatable support;

FIGS. 28-30 are respectively a perspective view, lateral and from above of the adapted toe-piece of a ski binding for also allowing walking uphill, object of the present invention, according to a first embodiment of the invention in an uphill walking configuration, as well as of a ski boot that is hooked to the above-mentioned toe-piece of the ski binding for downhill skiing;

FIG. 31 differs from FIG. 28 in that the ski boot is not shown;

FIG. 32 differs from FIG. 31 in that it is in cross section according to a longitudinal section plane;

FIG. 33 is a perspective view alike to that of FIG. 31, but taken from a different angle;

FIG. 34 differs from FIG. 33 in that it is in cross section according to a longitudinal section plane;

FIG. 35 differs from FIG. 30 in that the ski boot is not shown;

FIG. 36 is a view of section XXXVI-XXXVI of FIG. 35;

FIG. 37 is a view of section XXXVII-XXXVII of FIG. 36;

FIG. 38 is a view from below of the toe-piece of the ski binding of FIGS. 28-30;

FIG. 39 differs from FIG. 29 in that the ski boot is not shown;

FIG. 40 is a view according to section plane XXXX-XXXX of FIG. 39;

FIG. 41 is identical to FIG. 39;

FIG. 42 is a view according to section XXXXII-XXXXII of FIG. 41;

FIG. 43 is a view alike to that of FIGS. 39, 41, which relates to when the adapted toe-piece of a ski binding for also allowing walking uphill is in a configuration ready to receive the ski boot for the walk uphill;

FIG. 44 is a view according to section plane XXXXIV-XXXXIV of FIG. 43;

FIG. 45 is identical to FIG. 43;

FIG. 46 is a view according to section plane XXXXVI-XXXXVI of FIG. 45;

FIG. 47 is a view from below of the toe-piece of the ski binding of FIGS. 28-30, alike to FIG. 38 but in perspective view;

FIG. 48 is alike to FIG. 47, with the difference that it is taken from a different angle and in that the base has been omitted;

FIGS. 49, 50 are two perspective views alike to FIG. 48, with the difference that they are taken from different angles and that further components have been omitted;

FIGS. 51, 52 are two perspective views alike to FIGS. 49 and 50, with the difference that they are taken from different angles and that further components have been omitted;

FIG. 53 is a perspective view alike to those of FIGS. 51 and 52, with the difference that further components have been omitted;

FIGS. 54, 55 are two perspective views alike to FIG. 53, with the difference that they are taken from different angles and that further components have been omitted;

FIGS. 56, 57 are a frontal view and a perspective view, in which, with respect to FIGS. 54 and 55, further components have been omitted;

FIG. 58 is a perspective view of the toe-piece of the ski binding of FIGS. 28-30, showing only the base, the first rotatable support and second rotatable support;

FIGS. 59-61 are respectively a perspective view, lateral and from above of an adapted toe-piece of a ski binding for also allowing walking uphill, object of the present invention, according to a second embodiment of the invention and in the ski descent configuration, as well as a ski boot that is hooked to the above-mentioned toe-piece of the ski binding for downhill skiing;

FIG. 62 differs from FIG. 59 in that the ski boot is not shown and the fact that it is taken from a different angle;

FIG. 63 differs from FIG. 62 in that it is in cross section according to a longitudinal section plane;

FIG. 64 is a perspective view alike to that of FIG. 62, but taken from a different angle;

FIG. 65 differs from FIG. 64 in that it is in cross section according to a longitudinal section plane;

FIG. 66 differs from FIG. 61 in that the ski boot is not shown;

FIG. 67 is a view of section LXVII-LXVII of FIG. 66;

FIG. 68 is a view of section LXVIII-LXVIII of FIG. 67;

FIG. 69 is a view from below of the toe-piece of the ski binding of FIGS. 59-61;

FIG. 70 differs from FIG. 60 in that the ski boot is not shown;

FIG. 71 is a view according to section plane LXXI-LXXI of FIG. 70;

FIG. 72 is a view according to section plane LXXII-LXXII of FIG. 70;

FIG. 73 is alike to FIG. 72, with the difference that it is a perspective view and in that additional characteristics are shown which in section LXXII-LXXII would not have been visible;

FIG. 74 differs from FIG. 62 in that it is taken from another angle and that the base has been omitted;

FIGS. 75, 76 are two further perspective views alike to FIG. 74, with the difference that they are taken from different angles and that further components have been omitted;

FIGS. 77, 78 are two perspective views alike to FIGS. 75 and 76, with the difference that they are taken from different angles and that further components have been omitted;

FIG. 79 is a perspective view alike to those of FIGS. 77 and 78, with the difference that it is taken from a different angle and in that further components have been omitted;

FIGS. 80, 81 are two further perspective views alike to FIG. 79, with the difference that they are taken from different angles and that further components have been omitted;

FIGS. 82, 83 are perspective views of the toe-piece of the ski binding of FIGS. 59-61, in which only some components are shown, among which the base, the first rotatable support and the second rotatable support;

FIGS. 84-86 are respectively a perspective view, lateral and from above of the adapted toe-piece of a ski binding for also allowing walking uphill, object of the present invention, according to the second embodiment in an uphill walking configuration, as well as a ski boot that is hooked to the above-mentioned toe-piece of the ski binding for downhill skiing;

FIG. 87 differs from FIG. 84 in that the ski boot is not shown;

FIG. 88 differs from FIG. 87 in that it is in cross section according to a longitudinal section plane;

FIG. 89 is a perspective view alike to that of FIG. 87, but taken from a different angle;

FIG. 90 differs from FIG. 89 in that it is in cross section according to a longitudinal section plane;

FIG. 91 differs from FIG. 86 in that the ski boot is not shown;

FIG. 92 is a view of section XCII-XCII of FIG. 91;

FIG. 93 is a view of section XCIII-XCIII of FIG. 92;

FIG. 94 is a view from below of the toe-piece of the ski binding of FIGS. 84-86);

FIG. 95 differs from FIG. 85 in that the ski boot is not shown;

FIG. 96 is a view according to section plane XCVI-XCVI of FIG. 95;

FIG. 97 is a view according to section plane XCVII-XCVII of FIG. 95;

FIG. 98 is alike to FIG. 97, with the difference that it is a perspective view and in that additional characteristics are shown which in section XCVII-XCVII would not have been visible;

FIG. 99 is a view alike to that of FIGS. 95, but which relates to when the adapted toe-piece of a ski binding for also allowing walking uphill is in a configuration ready to receive the ski boot for the walk uphill;

FIG. 100 is a view according to section plane C-C of FIG. 99;

FIG. 101 is a view according to section plane CI-CI of FIG. 99;

FIG. 102 is alike to FIG. 101, with the difference that it is a perspective view and in that additional characteristics are shown which in section CI-CI would not have been visible;

FIG. 103 differs from FIG. 87 in that it is taken from another angle and that the base has been omitted;

FIGS. 104, 105 are two further perspective views alike to FIG. 103, with the difference that they are taken from different angles and that further components have been omitted;

FIGS. 106, 107 are two perspective views alike to FIGS. 104 and 105, with the difference that they are taken from different angles and that further components have been omitted;

FIG. 108 is a perspective view alike to those of FIGS. 106 and 107, with the difference that it is taken from a different angle and in that further components have been omitted;

FIGS. 109, 110 are two further perspective views alike to FIG. 108, with the difference that they are taken from different angles and that further components have been omitted;

FIGS. 111, 112 are perspective views of the toe-piece of the ski binding of FIGS. 84-86, in which only some components are shown, among which the base, the first rotatable support and the second rotatable support.

Figure 6:
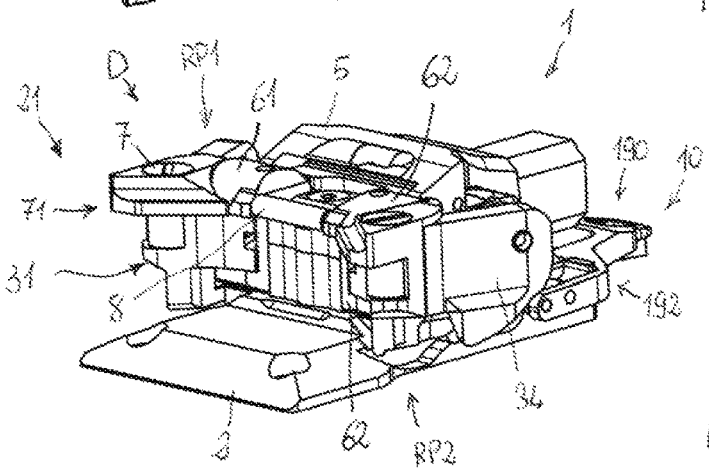
Figure 7:
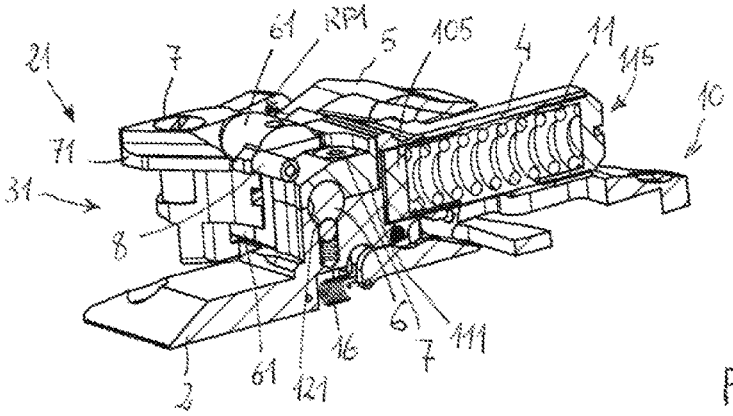
Figure 9:
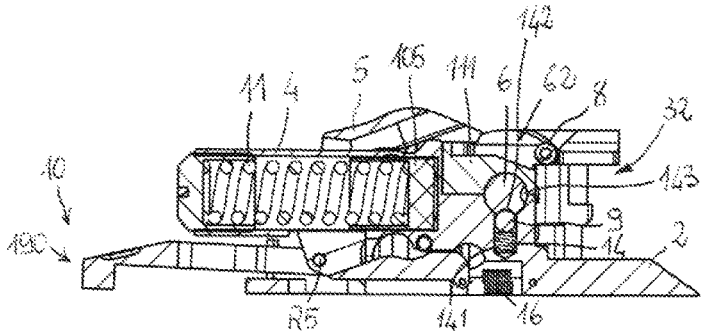
FIG. 9 is a view of section IX-IX of FIG. 8.

With reference to the appended tables of drawings, reference numeral (1) denotes in its entirety an adapted toe-piece of a ski binding for also allowing walking uphill, object of the present invention, comprising: a base (2) which is fixable to a ski (30) (a portion of ski has been shown only in FIG. 2); first elastic means (11) (FIGS. 5 7, 9 for example) which are borne by the base (2); a first clamping member (21) which is borne by the base (2), which is rotatable with respect to a first rotation axis (R1) (FIGS. 3 and 8, for example) and which is provided with a first jaw (31); a second clamping member (22) which is borne by the base (2), which is rotatable with respect to a second rotation axis (R2) (FIGS. 3 and 8, for example) and which is provided with a second jaw (32). The adapted toe-piece of a ski binding for also allowing walking uphill (1), in the following also referred-to as "the adapted toe-piece of a ski binding", can assume a ski descent configuration (D) (FIGS. 1-27, 59-83), so that when the base (2) is fixed to the ski (30) (FIG. 2) it is possible to ski downhill. Further, in the ski descent configuration (D) and when the base (2) is fixed to the ski (30): the first jaw (31) assumes a first abutting position (G1) (FIGS. 3 and 8, for example) able to abut a first lateral portion (41) (FIG. 3 for example) of the tip (3) of the ski boot, and can elastically retract with respect to the first abutting position (G1), by rotating with respect to the first rotation axis (R1) (in a clockwise direction in FIG. 3), if solicited by the tip (3) of the ski boot against the action of the first elastic means (11), so that the tip (3) of the ski boot can disengage from the toe-piece of the adapted toe-piece of a ski binding (1); the second jaw (32) assumes a second abutting position (G2) (FIGS. 3 and 8, for example) able to abut a second lateral portion (42) (FIG. 3 for example) of the tip (3) of the ski boot, opposite the first lateral portion (41) of the tip (3) of the ski boot, and can elastically retract with respect to the second abutting position (G2), by rotating with respect to the second rotation axis (R2) (in an anticlockwise direction in FIG. 3), if solicited by the tip (3) of the ski boot against the action of the first elastic means (11), so that the tip (3) of the ski boot can disengage from the adapted toe-piece of a ski binding (1). Further, the first clamping member (21) is provided with a third jaw (33); the third jaw (33) is provided with a first pin (51) (FIG. 3 for example) able to insert in a first hole (not illustrated) fashioned in the tip (3) of the ski boot; the second clamping member (22) is provided with a fourth jaw (34); the fourth jaw (34) is provided with a second pin (52) (FIG. 3 for example) able to insert in a second hole (not illustrated) fashioned in the tip (3) of the ski boot. Additionally, the adapted toe-piece of a ski binding (1) comprises a first rotatable support (61) (FIGS. 7, 27 for example) which: is borne by the base (2); rotatably bears the first clamping member (21) with respect to the first rotation axis (R1) (with reference to the figures, note in particular a first swivel pin (81) of the first rotatable support, with respect to which the first clamping member (21) can rotate, illustrated in FIGS. 25, 26); is rotatable about a third rotation axis (R3) (illustrated in FIG. 27), and thus is able to assume a first rotation position (RP1) (FIGS. 1-27, 59-83) so that the first jaw (31) is in the first abutting position (G1). Additionally, the adapted toe-piece of a ski binding (1) comprises a second rotatable support (62) (FIGS. 6 and 27, for example) which: is borne by the base (2); rotatably bears the second clamping member (22) with respect to the second rotation axis (R2); is rotatable about a fourth rotation axis (R3) (not illustrated), and thus is able to assume a second rotation position (RP2) (FIGS. 1-27, 59-83) so that the second jaw (32) is in the second abutting position (G2). Additionally, the first rotatable support (61) can also assume a third rotation position (RP3) (FIGS. 28-58; 84-112) and the second rotatable support (62) can also assume a fourth rotation position (RP4) (FIGS. 28-58; 84-112), so that by interposing the tip (3) of the ski boot between the third jaw (33) and the fourth jaw (34) at a predetermined position, the rotation of the third jaw (33) with respect to the first rotation axis (R1) can determine the inserting of the first pin (51) in the first hole of the tip (3) of the ski boot, and the rotation of the fourth jaw (34) with respect to the second rotation axis (R2) can determine the inserting of the second pin (52) in the second hole of the tip (3) of the ski boot. Further, the adapted toe-piece of a ski binding (1) comprises blocking means (10) which when: the base (2) is fixed to the ski (30); the first rotatable support (61) is in the third rotation position (RP3); the second rotatable support (62) is in the fourth rotation position (RP4); and the tip (3) of the ski boot is in the predetermined position (visible for example in FIGS. 28, 30) between the third jaw (33) and the fourth jaw (34), the blocking means are activatable to block the third jaw (33) and the fourth jaw (34) in angular blocking positions (FIGS. 40, 42 for example) in which the first pin (51) is inserted in the first hole of the ski boot and the second pin (52) is inserted in the second hole of the ski boot, making walking uphill possible (see for example FIGS. 28-58).

Figure 5:
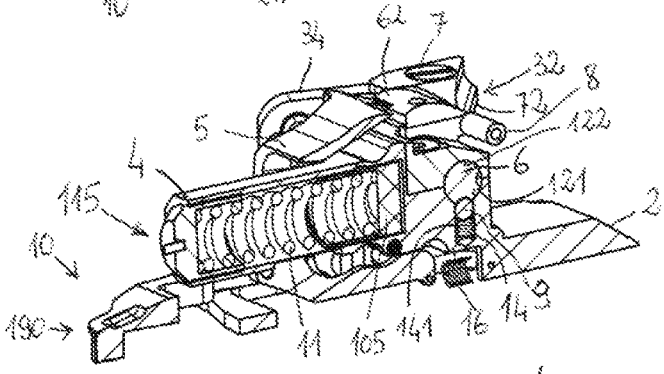

The first elastic means (11) can comprise a compression spring (see for example FIG. 5).

The first jaw (31) can be provided with a first projection (71) (FIG. 7 for example) able to abut an upper side of the first lateral portion (41) of the tip (3) of the ski boot (30).

Likewise, the second jaw (32) can be provided with a second protrusion (72) (FIG. 16 for example) able to abut an upper side of the second lateral portion (42) of the tip (3) of the ski boot (30).

Both the first projection (71) and the second projection (72) can perform the function of maintaining the tip (3) of the ski boot in contact with the base (2), thus realising the coupling of the tip (3) of the ski boot with the adapted toe-piece of a ski binding (1), so as to enable skiing downhill.

In the ski descent configuration (D), the first rotation axis (R1) and the second rotation axis (R2) can both be perpendicular to the ski (30) (FIG. 3 for example), when the base (2) is fixed to the ski (30).

The third jaw (33) is preferably solidly constrained to the first jaw (31). The first clamping member (21) can be formed by two different pieces, fixed to one another by a fixing element (7) (FIG. 23 for example; see also FIG. 24, in which the fixing element has been omitted): one piece bears the first jaw (31), while the other piece bears the third jaw (33). Alternatively (not illustrated) the first clamping member (21) is in a single body.

The fourth jaw (34) is preferably solidly constrained to the second jaw (32). The second clamping member (22) can be formed by two different pieces, fixed to one another by a fixing element (FIG. 23 for example): one piece bears the second jaw (32), while the other piece bears the fourth jaw (34). Alternatively (not illustrated) the second clamping member (22) is in a single body.

The first rotatable support (61) is preferably provided with a first swivel pin (81) to which the first clamping member (21) is hinged, so as to rotate with respect to the first hinge axis. As already specified, this first swivel pin (81) is clearly visible in FIGS. 25, 26.

The second rotatable support (62) is preferably provided with a second swivel pin (82) to which the second clamping member (22) is hinged, so as to rotate with respect to the second hinge axis.

The third rotation axis (R3) (FIG. 27) is preferably transversal to the axis of the ski (30) when the base (2) is fixed to the ski (30). Still more preferably, the third rotation axis (R3) is perpendicular to the axis of the ski (30) and parallel to the ski (30) when the base (2) is fixed to the ski (30).

The fourth rotation axis (R4) is preferably transversal to the axis of the ski (30) when the base (2) is fixed to the ski (30). Still more preferably, the fourth rotation axis (R3) is perpendicular to the axis of the ski (30) and parallel to the ski (30) when the base (2) is fixed to the ski (30).

According to a preferred aspect of the invention, the blocking means (10) comprise: a first sliding seat (91) (for example FIGS. 15, 27, 42, 44) which is borne by the base (2) and which is in communication with the outside; a first pusher (101) which is slidable along the first sliding seat (91), so as to partially exit out of the second sliding seat; a second sliding seat (92) (FIGS. 15, 42, 44) which is borne by the base (2) and which is in communication with the outside; a second pusher (102) which is slidable along the second sliding seat (92), so as to partially exit out of the second sliding seat; a blocking lever (5) which is rotatably borne by the base (2) so as to assume a blocking position (BP), and a non-active position (DP); a kinematic connection (170, 171, 172, 70, 221, 222) which connects the blocking lever (5) with the first pusher (101) and the second pusher (102). The blocking means (10) are configured in such a way that when: the base (2) is fixed to the ski (30); the first rotatable support (61) is in the third rotation position (RP3); the second rotatable support (62) is in the fourth rotation position (RP4); and the tip (3) of the ski boot is in the predetermined position between the third jaw (33) and the fourth jaw (34) (FIGS. 28-30, for example), then the movement of the blocking lever (5) into the blocking position (BP) determines, via the kinematic connection (170, 171, 172, 70, 221, 222), a corresponding outwards movement of the first pusher (101) and the second pusher (102) (see FIGS. 46 and 42 in succession) which in turn abut and move the first clamping member (21) and the second clamping member (22) respectively, up to blocking the third jaw (33) and the fourth jaw (34) in the angular blocking positions (FIGS. 40, 42 for example).

The first sliding seat (91) can be an integral part of the base (2), as illustrated in the drawings, or can be an individual element fixed to the base (2). The same is true of the second sliding seat (92).

The first sliding seat (91) and the second sliding seat (92) can be orientated transversally, preferably perpendicularly, with respect to the axis of the ski (30), when the base (2) is fixed to the ski (30).

According to a further preferred aspect of the invention, the first pusher (101) has an end, which partially exits the first sliding seat (91) and is able to abut the first clamping member (21), and another opposite end which is provided with a first coupling profile (75, 161) (FIG. 15 for example); the second pusher (102) has an end, which partially exits the second sliding seat (92) and is able to abut the second clamping member (22), and another opposite end which is provided with a second coupling profile (76, 162) (FIG. 15 for example); the kinematic connection (170, 171, 172, 70, 221, 222) comprises a connecting member (170), a first abutting element (171, 221) and a second abutting element (172, 222) (FIG. 13 for example); the connecting member (170) is connected to the blocking lever (5); the first abutting element (171, 221) is borne by the connecting member (170) and is arranged to engage with the first coupling profile (75, 161) of the first pusher (101); the second abutting element (172, 222) is borne by the connecting member (170) and is arranged to engage with the second coupling profile (76, 162) of the second pusher (102); the blocking means (10) are configured in such a way that when: the base (2) is fixed to the ski (30); the first rotatable support (61) is in the third rotation position (RP3); the second rotatable support (62) is in the fourth rotation position (RP4); and the tip (3) of the ski boot is in a predetermined position between the third jaw (33) and the fourth jaw (34), then the movement of the blocking lever (5) into the blocking position (BP) determines a movement of the first abutting element (171, 221) and the second abutting element (172, 222) which determines an outwards movement of the first pusher (101) and the second pusher (102) which in turn abut and move the first clamping member (21) and the second clamping member (22) respectively, up to blocking the third jaw (33) and the fourth jaw (34) in the angular blocking positions.

The fourth rotation axis can be offset with respect to the third rotation axis (R3) (solution not shown in the figures).

The first rotatable support (61) and the second rotatable support (62) can be separated from one another (solution not shown in the figures).

The first rotatable support (61) and the second rotatable support (62) are preferably mutually connected so as to be solidly connected to one another, and the fourth rotation axis (R4) coincides with the third rotation axis (R3).

The adapted toe-piece of a ski binding (1) preferably comprises a cylindrical connector (6) (FIGS. 23-27, for example) which rigidly connects the first rotatable support (61) and the second rotatable support (62) to one another, which bears (FIG. 27 for example) both the first rotatable support (61) and the second rotatable support (62) in a cantilever fashion and which is rotatable with respect to the third rotation axis (R3).

The adapted toe-piece of a ski binding (1) can comprise a connecting roller (8) which is idle and which connects the first rotatable support (61) and the second rotatable support (62) to one another, so as to increase the rigidity thereof. The position of the connecting roller (8) can be selected so as to abut an upper side of a central portion of the tip (3) of the ski boot (FIGS. 1, 3 for example).

Figure 8:
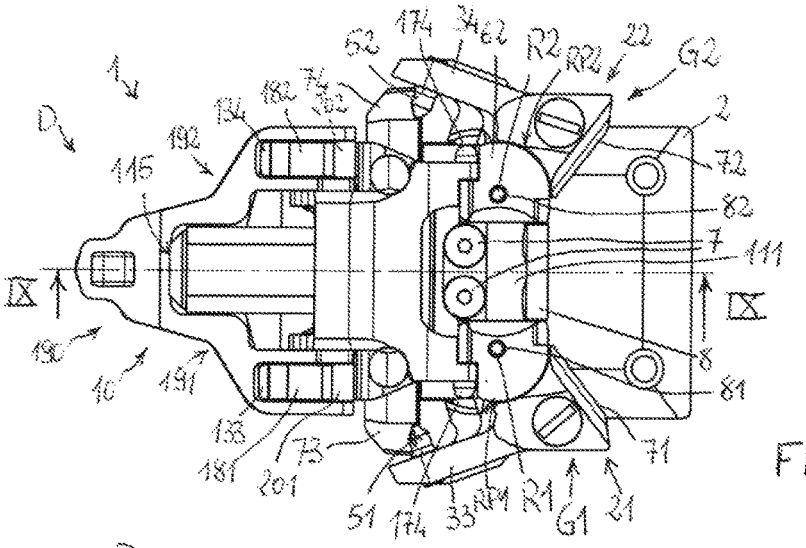

The adapted toe-piece of a ski binding (1) can comprise a first member (111) that is fixable with respect to the base (2), for example by screws (7) (two screws (7) are illustrated in the figures, see for example FIG. 8). The base (2) can be provided with a first semi-cylindrical seat (121) (FIGS. 5, 7), for receiving a portion of the cylindrical connector (6), while the first member (111) can be provided with a second semi-cylindrical seat (122) which is suitable for receiving a portion of the cylindrical connector (6) and which is opposite the first semi-cylindrical seat (121) when the first member (111) is fixed to the base (2), so that the first semi-cylindrical seat (121) and the second semi-cylindrical seat (122) define a revolute pair with the cylindrical connector (6).

The adapted toe-piece of a ski binding (1) preferably comprises:

- a third sliding seat (93) (FIGS. 2, 14 for example) which is borne by the base (2) and which has a relative first end in communication with the outside;
- a fourth sliding seat (94) (FIG. 14 for example) which is borne by the base (2) and which has a relative second end in communication with the outside;
- a third pusher (103) which: is slidable along the third sliding seat (93), in order to be able to partially exit out of the first sliding seat via a relative first free end; is connected to the first elastic means (11), on one side, and abuts the third jaw (33), on the other side, when the first rotatable support (61) is in the first rotation position (RP1), so that an anomalous solicitation on the first jaw (31), such as to cause a retraction of the first jaw (31) with respect to the first abutting position (G1), consequently determines a retraction of the third pusher (103) in an opposing direction with respect to the action exerted by the first elastic means (11);
- a fourth pusher (104) which: is slidable along the fourth sliding seat (94), so as to partially exit out of the fourth sliding seat via a relative second free end; is connected to the first elastic means (11), on one side, and abuts the fourth jaw (34), on the other side, when the second rotatable support (62) is in the second rotation position (RP2), so that an anomalous solicitation on the second jaw (32), such as to cause a retraction of the second jaw (32) with respect to the second abutting position (G2), consequently determines a retraction of the fourth pusher (104) in an opposing direction with respect to the action exerted by the first elastic means (11).

The adapted toe-piece of a ski binding (1) preferably comprises: a first abutment (131) (FIGS. 14, 40, 44 for example) which is borne by the base (2) and which is arranged so as to be able to abut the third pusher (103) so as to prevent the third pusher (103) from exiting beyond a predetermined quantity out of the third sliding seat (93); and a second abutment (132) (FIGS. 14, 40, 44 for example) which is borne by the base (2) and which is arranged so as to be able to abut the fourth pusher (104) so as to prevent the fourth pusher (103) from exiting beyond a predetermined quantity out of the fourth sliding seat (94).

The third sliding seat (93) can be an integral part of the base (2), as illustrated in the drawings, or can be an individual element fixed to the base (2). The same is true of the fourth sliding seat (94).

The third sliding seat (93) and the fourth sliding seat (94) can be orientated transversally, preferably perpendicularly, with respect to the axis of the ski (30), when the base (2) is fixed to the ski (30).

The third pusher (103) is preferably provided, at the relative first free end facing outwardly, with a third projection (73) (FIG. 3 for example) which extends in a cantilever fashion to abut the third jaw (33); the third projection (73) has an extension that is such as to prevent the first pin (51) from contacting the third pusher (103) when the first rotatable support (61) is in the first rotation position (RP1); the fourth pusher (104) is provided, at the relative second free end facing outwardly, with a fourth projection (74) (FIG. 3 for example) which extends in a cantilever fashion to abut the fourth jaw (34); the fourth projection (74) has an extension that is such as to prevent the second pin (52) from contacting the fourth pusher (104) when the second rotatable support (62) is in the second rotation position (RP2).

In the illustrated figures the third projection (73) and the fourth projection (74) are shaped as a shelf.

According to an aspect of the invention, the adapted toe-piece of a ski binding (1) comprises a housing (4) for the first elastic means (11), which is borne by the base (2) and which is open at a relative first housing end (4) thereof; the first elastic means (11) are arranged in the housing (4) (FIGS. 5, 7, 9, 14 for example); the third sliding seat (93) and the fourth sliding seat (94) are opposite one another with respect to the axis of the housing (4), in such a way that: the end of the third sliding seat (93) which is opposite the first end communicating with the outside environment is arranged in proximity of the first end of the housing (4); and the end of the fourth sliding seat (94) which is opposite the second end communicating with the outside environment is arranged in proximity of the first end of the housing (4); an end of the third pusher (103) which is opposite the relative first free end comprises a first inclined wall (151); the third pusher (103) is arranged in the third sliding seat (93) so that the relative end which comprises the first inclined wall (151) is arranged in proximity of the first end of the housing (4); an end of the fourth pusher (104) which is opposite the relative second free end comprises a second inclined wall (152); the fourth pusher (104) is arranged in the fourth sliding seat (94) so that the relative end which comprises the second inclined wall (152) is arranged in proximity of the first end of the housing (4). Further, again according to a this aspect of the invention, the adapted toe-piece of a ski binding (1) comprises a fifth pusher (105) (FIG. 21 for example) which is arranged in the housing (4) and maintained pressed by the first elastic means (11) towards the first end of the housing (4), and which is provided with a third inclined wall (153) for coupling with the first inclined wall (151) of the third pusher (103), and with a fourth inclined wall (154) for coupling with the second inclined wall (152) of the fourth pusher (104), so that a movement of the third pusher (103) along the third sliding seat (93) (example: an anomalous solicitation on the first jaw (31) and/or of the fourth pusher (104) along the fourth sliding seat (94) (example: an anomalous solicitation on the second jaw (32)) is transmitted to the fifth pusher (105) and from the fifth pusher (105) to the first elastic means (11), determining an elastic reaction (FIGS. 21, 22 for example).

The housing (4) can be arranged on the axis of the adapted toe-piece of a ski binding (1). The housing (4) can be an integral part of the base (2), as illustrated in FIG. 27, for example.

The adapted toe-piece of a ski binding (1) can comprise screw regulating means (115) (FIG. 1 for example) for regulating the preload value of the first elastic means (11), which are arranged at a second end of the housing (4), which is opposite the relative first end of the housing (4).

The adapted toe-piece of a ski binding (1) can comprise: second elastic means (12), for example a torque spring (FIGS. 14, 25, 26 for example), which are interposed between the first clamping member (21) and the first rotatable support (61), so as to rotate the third jaw (33) towards the fourth jaw (34); third elastic means (13), for example a torque spring (FIG. 14 for example), which are interposed between the second clamping member (62) and the second rotatable support (22), so as to rotate the fourth jaw (34) towards the third jaw (33).

According to a further aspect of the invention: the adapted toe-piece of a ski binding (1) can comprise fourth elastic means (14), for example a compression spring, and a sphere (9); the base (2) can be provided with a first blind hole (141) for housing the fourth elastic means (14) and the sphere (9); the cylindrical connector (6) can be provided with a second blind hole (142) (FIG. 9) arranged so as to partially receive the sphere (9), pressed by the fourth elastic means (14), when the first rotatable support (61) and the second rotatable support (62) are respectively in the first rotation position (RP1) and in the second rotation position (RP2) (FIGS. 5, 9 for example), so as to stabilise the position of the first rotatable support (61) and the second rotatable support (62); the cylindrical connector (6) can be provided with a third blind hole (143) (FIG. 9) arranged so as to partially receive the sphere (9), pressed by the fourth elastic means (14), when the first rotatable support (61) and the second rotatable support (62) are respectively in the third rotation position (RP3) and in the fourth rotation position (RP4) (FIGS. 32, 36 for example), so as to stabilise the position of the first rotatable support (61) and the second rotatable support (62).

The following is a description of a first embodiment of an adapted toe-piece of a ski binding (1) for also allowing walking uphill, object of the present invention, FIGS. 1-58. In particular, FIGS. 1-27 show a ski descent configuration (D), FIGS. 28-42, 47-58 show an uphill walking configuration (U), and FIGS. 43-46 show a configuration ready to receive the ski boot (R).

The connecting member (170) can be solidly connected to or integral with the blocking lever (5) (as in the drawings).

The first abutting element and the second abutting element can be opposite one another and orientated transversally, preferably perpendicularly, with respect to the axis of the ski (30), when the base (2) is fixed to the ski (30).

According to an aspect of the first embodiment of the invention: the first clamping member (21) is provided with a third coupling profile (163) (FIGS. 40, 42, 44, 46); the second clamping member (22) is provided with a fourth coupling profile (164); the blocking lever (5) is provided with a third abutting element (173) and a fourth abutting element (174); the blocking means (10) are configured in such a way that when: the base (2) is fixed to the ski (30); the first rotatable support (61) is in the third rotation position (RP3); the second rotatable support (62) is in the fourth rotation position (RP4); and the tip (3) of the ski boot is in a predetermined position between the third jaw (33) and the fourth jaw (34), then the movement of the blocking lever (5) into the non-active position (DP) determines a movement of the third abutting element (173) and of the fourth abutting element (174) which in turn abut and move the first clamping member (21) and the second clamping member (22) respectively, distancing the third jaw (33) and the fourth jaw (34) from one another, thus enabling the tip (3) of the ski boot to be positioned in the predetermined position between the third jaw (33) and the fourth jaw (34), with the third jaw (33) and the fourth jaw (34) having reached angular releasing positions (FIGS. 43-46).

The first sliding seat (91) and the second sliding seat (92) are preferably orientated transversally with respect to the axis of the ski (30), when the base (2) is fixed to the ski (30); the adapted toe-piece of a ski binding (1) preferably comprises fifth elastic means (15) (FIG. 15 for example) which comprise the first pusher (101) and the second pusher (102) outwardly, so that the first pusher (101) is maintained always in contact (FIG. 16 for example) with the first clamping member (21) and so that the second pusher (102) is maintained always in contact (FIG. 16 for example) with the second clamping member (22).

The first sliding seat (91) and the second sliding seat (92) are preferably coaxial and the fifth elastic means (15) comprise a spring interposed between the first pusher (101) and the second pusher (102), for pushing the first pusher (101) and the second pusher (102) outwardly.

According to a still further aspect of the first embodiment, the adapted toe-piece of a ski binding (1) comprises sixth elastic means (16) (FIG. 13 for example) which are interposed between the base (2) and the blocking lever (5), in order to bring the blocking lever (5) towards the non-active position (DP), and a maneuvering lever (190) for commanding the blocking lever (5) and comprising a first prong (191) and a second prong (192). The base (2) is provided with a first rolling track (181) and a second rolling track (182) (FIGS. 28-30, for example). The first prong (191) bears a first idle roller (201) at the relative free end; the second prong (192) bears a second idle roller (202) at the relative free end; the first prong (191) is rotatably coupled to the blocking lever (5) at an intermediate portion of the first prong (191); the second prong (192) is rotatably coupled to the blocking lever (5) at an intermediate portion of the second prong (192); the first prong (191) and the second prong (192) are rotatably coupled to the blocking lever (5) with respect to a fifth axis of rotation (R5) (FIG. 17 for example). The maneuvering lever (190) is configured in such a way that the first idle roller (201) can roll on the first rolling track (181) and the second idle roller (202) can roll on the second rolling track (182); further, the maneuvering lever (190) is activatable in order to be able to command the blocking lever (5), so that it can assume an extended position (DDP), in which the blocking lever (5) is in the non-active position (DP), and a raised position (BBP), in which the blocking lever (5) is in the blocking position (BP).

The sixth elastic means (16) are preferably interposed between the base (2) and the connecting member (170).

The first rolling track (181) can be delimited by a third abutment (133) (FIG. 28 for example), which is abutted by the first idle roller (201) when the maneuvering lever (190) reaches the raised position (BBP); likewise, the second rolling track (182) can be delimited by a fourth abutment (134), which is abutted by the second idle roller (202) when the maneuvering lever (190) reaches the raised position (BBP). The adapted toe-piece of a ski binding (1) can be configured so that when the maneuvering lever (190) reaches the raised position (BBP), then the sixth elastic means (16) stabilise the maneuvering lever (190) reaches the raised position (BBP).

The first prong (191) can have two arms, between which the first idle roller (201) is interposed.

The second prong (192) can have two arms, between which the second idle roller (202) is interposed (FIG. 16 for example).

The blocking lever (5) preferably comprises a first guide element (211) and a second guide element (212) (visible only in FIGS. 33, 52); the first guide element (211) has the shape of a projection for guiding the first prong (191) in such a way that the first roller rolls on the first rolling track (181); likewise, the second guide element (212) has the shape of a projection for guiding the second prong (192) in such a way that the second roller rolls on the second rolling track (182).

There follows a description of the functioning of the adapted toe-piece of a ski binding (1) for also allowing walking uphill, object of the present invention, according to a first embodiment of the invention as illustrated in FIGS. 1-58.

As already specified, FIGS. 1-27 illustrate the ski descent configuration (D). In particular, FIGS. 1-3 show the tip (3) of the ski boot hooked to the adapted toe-piece of a ski binding (1): as can be seen, the first jaw (31), the second jaw (32) and the connecting roller (8) abut respectively the first lateral portion (41), the second lateral portion (42) and the central portion of the tip (3) of the ski boot, so as to maintain the tip (3) of the ski boot in contact with the base (2).

In a case in which the ski boot (30) solicits the first jaw (31) or the second jaw (32), for example due to an impact or a fall of the skier, to the extent that the solicitation exceeds a predetermined threshold value, then the first jaw (31) or the second jaw (32) retracts elastically (situation not illustrated) and the ski boot (30) unhooks from the adapted toe-piece of a ski binding (1), so as to avoid an incident for the skier.

Note that in the ski descent configuration (D), the maneuvering lever (190) is maintained in the extended position (DDP) so that the blocking lever (5) is in the non-active position (DP).

To bring the adapted toe-piece of a ski binding (1) into the uphill walking configuration (U), the ski boot (30) must be unhooked from the adapted toe-piece of a ski binding (1).

Starting from the ski descent configuration (D), FIGS. 1-27, it is necessary to grip and rotate the first clamping member (21) and the second clamping member (22), so that they reach respectively the third rotation position (RP3) and the fourth rotation position (RP4). The adapted toe-piece of a ski binding (1) is thus located in the configuration ready to receive the ski boot (R), as illustrated in FIGS. 43-46.

At this point the tip (3) of the ski boot is inserted in the predetermined position, between the third jaw (33) and the fourth jaw (34), and the maneuvering lever (190) is brought into the raised position (BBP), so that the blocking lever (5) moves into the blocking position (BP): to view the rotary movement of the third jaw (33) and the fourth jaw (34), from the angular blocking positions to the angular releasing positions, observe, in succession, FIGS. 43-46 and then FIGS. 39-42.

At this point the adapted toe-piece of a ski binding (1) is in the uphill walking configuration (U), in FIGS. 28-42 and 47-58, and it is possible to walk uphill (see in particular FIGS. 28-30).

In order to newly ski downhill, the maneuvering lever (190) must be brought into the extended position (DDP) (FIGS. 43-46), so that the tip (3) of the ski boot unhooks from the adapted toe-piece of a ski binding (1), the first rotatable support (61) and the second rotatable support (62) rotate into the first rotation position (RP1) and into the second rotation position (RP2), so that the tip (3) of the ski boot engages to the adapted toe-piece of a ski binding (1).

The following is a description of a second embodiment of an adapted toe-piece of a ski binding (1) for also allowing walking uphill, object of the present invention, FIGS. 59-112. In particular, FIGS. 59-83 show a ski descent configuration (D), FIGS. 84-98, 103-112 show an uphill walking configuration (U), and FIGS. 99-102 show a configuration ready to receive the ski boot (R). The adapted toe-piece of a ski binding (1) comprises seventh elastic means (1700) (FIGS. 63, 75, 77 for example), for example a spring, which are preferably interposed between the base (2) and the connecting member (170), in order to bring the blocking lever (5) into the blocking position (BP).

The first sliding seat (91) and the second sliding seat (92) are orientated transversally with respect to the axis of the ski (30), when the base (2) is fixed to the ski (30).

The first abutting element and the second abutting element are integrated in a dovetailed member (70) which is provided with two lateral walls, which are opposite and inclined: in proximity of each lateral wall there is at least a groove (221, 222) which extends parallel to the lateral wall. The dovetailed member (70) therefore comprises having at least a first groove (221), which corresponds to the first abutting element (in the figures there are two that are opposite, see FIG. 71), and at least a second groove (222), which corresponds to the second abutting element (in the figures there are two that are opposite, see FIG. 71) (FIGS. 69, 72 for example).

The end of the first pusher (101) which is opposite the relative first free end is provided with at least a fifth projection (75) (in the figures there are two that are opposite, see FIG. 71) which corresponds to the first coupling profile and which engages in the first groove (221), while the end of the second pusher (102) which is opposite the relative first free end is provided with at least a sixth projection (76) (in the figures there are two that are opposite, see FIG. 71) which corresponds to the second coupling profile and which engages in the second groove (222).

The dovetailed member (70) is orientated so that the relative inclined walls converge towards the front part of the ski (30), when the base (2) is fixed to the ski (30) (FIGS. 72, 73 for example). Therefore, a movement of the connecting member (170) towards the rear part of the ski (30) determines a partial return of the first pusher (101) and the second pusher (102), while, vice versa, a movement of the connecting member (170) towards the front part of the ski (30) determines a partial exit of the first pusher (101) and the second pusher (102).

The first clamping member (21) is provided with a fifth abutting element (175), the second clamping member (22) is provided with a sixth abutting element (176), the free end of the first pusher (101) is provided with a first through-opening (231) for receiving, with play, the fifth abutting element (175), the free end of the second pusher (102) is provided with a second through-opening (232) for receiving, with play, the sixth abutting element (176). The adapted toe-piece of a ski binding (1) is configured in such a way that when the first rotatable support (61) and the second rotatable support (62) are brought, respectively, into the third rotation position (RP3) and into the fourth rotation position (RP4), then the fifth abutting element (175) locates in the first through-opening (231) and the sixth abutting element (176) locates in the second through-opening (232), so that a movement of both the first pusher (101) and the second pusher (102) can determine a distancing or a nearing of the third jaw (33) and the rotation of the fourth jaw (34) to one another.

The connecting member (170) is provided with a third swivel pin (83) and a fourth swivel pin (84), which are both in a revolute pair with the blocking lever (5). The connecting member (170) has an oblong shape, an the third swivel pin (83) and the fourth swivel pin (84) can be opposite one another and perpendicular to the axis of the connecting member (170). Further, the third swivel pin (83) and the fourth swivel pin (84) can be in a single piece (see for example FIG. 67).

The base (2) comprises a first slot (241) and a second slot (242): the first slot (241) is arranged so as to enable passage through it of the third swivel pin (83), and has an arched shape so as to enable the third swivel pin (83) to perform a run, and therefore also the connecting member (170), when the blocking lever (5) is activated; likewise, the second slot (242) is arranged so as to enable passage through it of the fourth swivel pin (84), and has an arched shape to allow the rotation of the fourth swivel pin (84), with a consequent movement of the connecting member (170), when the blocking lever (5) is activated. When the blocking lever (5) is in the blocking position (BP), the third swivel pin (83) abuts an end of the first slot (241) and the fourth swivel pin (84) abuts an end of the second slot (242); this represents and endrun stop for the connecting member (170) which is subjected to the action of the seventh elastic means (1700).

The adapted toe-piece of a ski binding (1) preferably comprises a seventh abutting element (177) and an eighth abutting element (178), which are rotatingly borne respectively by the third swivel pin (83) and the fourth swivel pin (84). Both the seventh abutting element (177) and the eighth abutting element (178) are dimensioned in such a way that when the blocking lever (5) is in the blocking position (BP), they abut corresponding walls of the base (2) preventing the third swivel pin (83) and the fourth swivel pin (84) from crossing respectively the first slot and the second slot. Consequently also the connecting member (170) is blocked as are the first pusher (101) and the second pusher (102), as well as the third jaw (33) and the fourth jaw (34) in the angular blocking positions.

There follows a description of the functioning of the adapted toe-piece of a ski binding (1) for also allowing walking uphill, object of the present invention, according to the second embodiment illustrated in FIGS. 59-112.

As already specified, FIGS. 59-83 illustrate the ski descent configuration (D). In particular, FIGS. 59-61 show the tip (3) of the ski boot hooked to the adapted toe-piece of a ski binding (1): as can be seen, the first jaw (31), the second jaw (32) and the connecting roller (8) respectively abut the first lateral portion (41), the second lateral portion (42) and the central portion of the tip (3) of the ski boot, so as to maintain the tip (3) of the ski boot in contact with the base (2).

In a case in which the ski boot (30) solicits the first jaw (31) or the second jaw (32), for example due to an impact or a fall of the skier, to the extent that the solicitation exceeds a predetermined threshold value, then the first jaw (31) or the second jaw (32) retracts elastically (situation not illustrated) and the ski boot (30) unhooks from the adapted toe-piece of a ski binding (1), so as to avoid an incident for the skier.

Note that the blocking lever (5) tends to remain constantly in the blocking position (BP), due to the action of the seventh elastic means (1700).

To bring the adapted toe-piece of a ski binding (1) into the uphill walking configuration (U), the ski boot (30) must be unhooked from the adapted toe-piece of a ski binding (1).

Starting from the ski descent configuration (D), FIGS. 59-83, it is necessary to grip and rotate the first clamping member (21) and the second clamping member (22), so that they reach respectively the third rotation position (RP3) and the fourth rotation position (RP4). The adapted toe-piece of a ski binding (1) is thus in the uphill walking configuration (U), as illustrated in FIGS. 84-98 and 103-112.

At this point the blocking lever (5) must be brought into the non-active position (DP), FIGS. 99-102, to distance the third jaw (33) and the fourth jaw (34) from one another and the tip (3) of the ski boot is inserted in the predetermined position, between the third jaw (33) and the fourth jaw (34).

Then, the blocking lever (5) is brought into the blocking position (BP), so that the first pin (51) inserts in the first hole of the tip (3) of the ski boot and the second pin (52) inserts in the second hole of the tip (3) of the ski boot, with a consequent hooking of the tip (3) of the ski boot with the adapted toe-piece of a ski binding (30).

To view the rotary movement of the third jaw (33) and the fourth jaw (34), from the angular blocking positions to the angular releasing positions, see, in succession, FIGS. 95-98 and then FIGS. 99-102.

At this point the adapted toe-piece of a ski binding (1) is in the uphill walking configuration (U), in FIGS. 84-98 and 103-112, and it is possible to walk uphill (see in particular FIGS. 59-61).

In order to newly ski downhill, the blocking lever (5) must be brought into the non-active position (DP) and the tip (3) of the ski boot removed from the predetermined position. Then, the first rotatable support (61) and the second rotatable support (62) are rotated into the first rotation position (RP1) and into the second rotation position (RP2), so that the tip (3) of the ski boot engages to the adapted toe-piece of a ski binding (1).

It is understood that the above has been described by way of non-limiting example and that any technical-functional variants are considered to fall within the protective scope of the present technical solution, as claimed in the following.

The invention claimed is:

1. An adapted toe-piece of a ski binding, comprising:

a base which is fixable to a ski so that in a ski descent configuration with the base fixed to a ski it is possible to ski downhill;

first elastic means which are borne by the base;

a first clamping member which is borne by the base, which is rotatable with respect to a first rotation axis and which is provided with a first jaw;

a second clamping member which is borne by the base, which is rotatable with respect to a second rotation axis and which is provided with a second jaw;

wherein in the ski descent configuration and when the base is fixed to the ski: the first jaw assumes a first abutting position able to abut a first lateral portion of the tip of a ski boot, and can elastically retract with respect to the first abutting position, by rotating with respect to the first rotation axis, if solicited by the tip of the ski boot against the action of the first elastic means; the second jaw assumes a second abutting position able to abut a second lateral portion of the tip of the ski boot, opposite the first lateral portion of the tip of the ski boot, and can elastically retract with respect to the second abutting position, by rotating with respect to the second rotation axis, if solicited by the tip of the ski boot against the action of the first elastic means;

wherein:

the first clamping member is provided with a third jaw;

the third jaw is provided with a first pin able to insert in a first hole fashioned in the tip of a ski boot;

the second clamping member is provided with a fourth jaw;

the fourth jaw is provided with a second pin able to insert in a second hole fashioned in the tip of the ski boot;

further comprising:

a first rotatable support which: is borne by the base; rotatably bears the first clamping member with respect to the first rotation axis; is rotatable about a third rotation axis, thus being able to assume a first rotation position so that the first jaw is in the first abutting position;

a second rotatable support which: is borne by the base; it rotatably bears the second clamping member with respect to the second rotation axis; it is rotatable about a fourth rotation axis, thus being able to assume a second rotation position so that the second jaw is in the second abutting position;

wherein the first rotatable support can also assume a third rotation position and the second rotatable support can also assume a fourth rotation position, so that by interposing the tip of the ski boot between the third jaw and the fourth jaw at a predetermined position, the rotation of the third jaw with respect to the first rotation axis can determine the inserting of the first pin in the first hole of the tip of the ski boot, and the rotation of the fourth jaw with respect to the second rotation axis can determine the inserting of the second pin in the second hole of the tip of the ski boot;

further comprising blocking means which when: the base is fixed to the ski; the first rotatable support is in the third rotation position; the second rotatable support is in the fourth rotation position; and the tip of the ski boot is in the predetermined position between the third jaw and the fourth jaw, the blocking means are activatable to block the third jaw and the fourth jaw in angular blocking positions in which the first pin is inserted in the first hole of the ski boot and the second pin is inserted in the second hole of the ski boot, making walking uphill possible.

2. The adapted toe-piece of a ski binding for also allowing walking uphill of claim 1, wherein:

the blocking means comprise: a first sliding seat which is borne by the base and which is in communication with the outside; a first pusher which is slidable along the first sliding seat, to partially exit out of the first sliding seat; a second sliding seat which is borne by the base and which is in communication with the outside; a second pusher which is slidable along the second sliding seat, to partially exit out of the second sliding seat; a blocking lever which is rotatably borne by the base to assume a blocking position and a non-active position; a kinematic connection which connects the blocking lever to the first pusher and the second pusher;

the blocking means are configured in such a way that when: the base is fixed to the ski; the first rotatable support is in the third rotation position; the second rotatable support is in the fourth rotation position; and the tip of the ski boot is in the predetermined position between the third jaw and the fourth jaw, the movement of the blocking lever into the blocking position determines, via the kinematic connection, a corresponding outwards movement of the first pusher and the second pusher which in turn abut and move the first clamping member and the second clamping member respectively, up to blocking the third jaw and the fourth jaw in the angular blocking positions.

3. The adapted toe-piece of a ski binding for also allowing walking uphill of claim 2, wherein:

the first pusher has an end, which partially exits the first sliding seat able to abut the first clamping member, and an opposite end which is provided with a first coupling profile;

the second pusher has an end, which partially exits the second sliding seat able to abut the second clamping member, and another opposite end which is provided with a second coupling profile;

the kinematic connection comprises a connecting member, a first abutting element and a second abutting element;

the connecting member is connected to the blocking lever;

the first abutting element is borne by the connecting member and is arranged to engage with the first coupling profile of the first pusher;

the second abutting element is borne by the connecting member and is arranged to engage with the second coupling profile of the second pusher;

the blocking means are configured in such a way that when: the base is fixed to the ski; the first rotatable support is in the third rotation position; the second rotatable support is in the fourth rotation position; and the tip of the ski boot is in the predetermined position between the third jaw and the fourth jaw, the movement of the blocking lever into the blocking position determines a movement of the first abutting element and of the second abutting element which determines an outwards movement of the first pusher and the second pusher which in turn abut and move the first clamping member and the second clamping member respectively, up to blocking the third jaw and the fourth jaw in the angular blocking positions.

4. The adapted toe-piece of a ski binding for also allowing walking uphill of claim 3, wherein:

the first clamping member is provided with a third coupling profile;

the second clamping member is provided with a fourth coupling profile;

the blocking lever is provided with a third abutting element and a fourth abutting element;

the blocking means are configured in such a way that when: the base is fixed to the ski; the first rotatable support is in the third rotation position; the second rotatable support is in the fourth rotation position; and the tip of the ski boot is in the predetermined position between the third jaw and the fourth jaw, the movement of the blocking lever into the non-active position determines a movement of the third abutting element and of the fourth abutting element which in turn abut and move the first clamping member and the second clamping member respectively, distancing the third jaw and the fourth jaw from one another, thus enabling the tip of the ski boot to be positioned in the predetermined position between the third jaw and the fourth jaw, the third jaw and the fourth jaw having reached angular releasing positions.

5. The adapted toe-piece of a ski binding for also allowing walking uphill of claim 2, wherein:

the first sliding seat and the second sliding seat are orientated transversally with respect to the axis of the ski, when the base is fixed to the ski;

it comprises further elastic means which press the first pusher and the second pusher outwardly, so that the first pusher is maintained always in contact with the first clamping member and so that the second pusher is maintained always in contact with the second clamping member.

6. The adapted toe-piece of a ski binding for also allowing walking uphill of claim 2, also comprising further elastic means which are interposed between the base and the blocking lever, in order to bring the blocking lever towards the non-active position;

wherein the base is provided with a first rolling track and a second rolling track;

further comprising a maneuvering lever for commanding the blocking lever, wherein: a first prong bears a first idle roller at the relative free end; a second prong bears a second idle roller at the relative free end; the first prong is rotatably coupled to the blocking lever at an intermediate portion of the first prong; the second prong is rotatably coupled to the blocking lever at an intermediate portion of the second prong; the first prong and the second prong are rotatably coupled to the blocking lever with respect to the same rotation axis; the maneuvering lever is configured in such a way that the first idle roller can roll on the first rolling track and the second idle roller can roll on the second rolling track; the maneuvering lever is activatable to command the blocking lever, so that it can assume an extended position in which the blocking lever is in the non-active position, and a raised position in which the blocking lever is in the blocking position.

7. The adapted toe-piece of a ski binding for also allowing walking uphill of claim 1, wherein the first rotatable support and the second rotatable support are solidly connected to one another and wherein the fourth rotation axis coincides with the third rotation axis.

8. The adapted toe-piece of a ski binding for also allowing walking uphill of claim 7, further comprising a cylindrical connector which rigidly connects the first rotatable support and the second rotatable support to one another, which bears both the first rotatable support and the second rotatable support in a cantilever fashion and which is rotatable with respect to the third rotation axis.

9. The adapted toe-piece of a ski binding for also allowing walking uphill of claim 8, further comprising a housing for the first elastic means, which is borne by the base and which is open at a relative first housing end thereof;

wherein:

the first elastic means are arranged in the housing;

the third sliding seat and the fourth sliding seat are opposite one another with respect to the axis of the housing, in such a way that: the end of the third sliding seat which is opposite the first end communicating with the outside is arranged in proximity of the first end of the housing; and the end of the fourth sliding seat which is opposite the second end communicating with the outside is arranged in proximity of the first end of the housing;

an end of the third pusher which is opposite the relative first free end comprises a first inclined wall;

the third pusher is arranged in the third sliding seat so that the relative end which comprises the first inclined wall is arranged in proximity of the first end of the housing;

an end of the fourth pusher which is opposite the relative second free end comprises a second inclined wall; and the fourth pusher is arranged in the fourth sliding seat so that the relative end which comprises the second inclined wall is arranged in proximity of the first end of the housing;

further comprising a fifth pusher which is arranged in the housing and maintained pressed by the first elastic means towards the first end of the housing, and which is provided with a third inclined wall for coupling with the first inclined wall of the third pusher and with a fourth inclined wall for coupling with the second inclined wall of the fourth pusher, so that a movement of the third pusher along the third sliding seat and/or of the fourth pusher along the fourth sliding seat is transmitted to the fifth pusher and from the fifth pusher to the first elastic means determining an elastic reaction.

10. The adapted toe-piece of a ski binding for also allowing walking uphill according to claim 1, further comprising:

a third sliding seat which is borne by the base and which has a relative first end in communication with the outside;

a fourth sliding seat which is borne by the base and which has a relative second end in communication with the outside;

a third pusher which: it is slidable along the third sliding seat, in order to partially exit out of the third sliding seat via a relative first free end; it is connected to the first elastic means, on one side, and abuts the third jaw, on the other side, when the first rotatable support is in the first rotation position, so that an anomalous stress on the first jaw, such as to cause a retraction of the first jaw with respect to the first abutting position, consequently determines a retraction of the third pusher against the action exerted by the first elastic means;

and a fourth pusher which: is slidable along the fourth sliding seat, so as to partially exit out of the fourth sliding seat via a relative second free end; is connected to the first elastic means, on one side, and abuts the fourth jaw, on the other side, when the second rotatable support is in the second rotation position, so that an anomalous stress on the second jaw, such as to cause a retraction of the second jaw with respect to the second abutting position, consequently determines a retraction of the fourth pusher against the action exerted by the first elastic means.

11. The adapted toe-piece of a ski binding for also allowing walking uphill of claim 10, wherein:

the third pusher is provided, at the relative first free end facing outwardly, with a third projection which extends in a cantilever fashion able to abut the third jaw;

the third projection has an extension that is such as to prevent the first pin from contacting the third pusher when the first rotatable support is in the first rotation position;

the fourth pusher is provided, at the relative second free end facing outwardly, with a fourth projection which extends in a cantilever fashion able to abut the fourth jaw;

the fourth projection has an extension that is such as to prevent the second pin from contacting the fourth pusher when the second rotatable support is in the second rotation position.

12. The adapted toe-piece of a ski binding for also allowing walking uphill of claim 10, further comprising a housing for the first elastic means, which is borne by the base and which is open at a relative first housing end thereof;

wherein:

the first elastic means are arranged in the housing;

the third sliding seat and the fourth sliding seat are opposite one another with respect to the axis of the housing, in such a way that: the end of the third sliding seat which is opposite the first end communicating with the outside is arranged in proximity of the first end of the housing; and the end of the fourth sliding seat which is opposite the second end communicating with the outside is arranged in proximity of the first end of the housing;

an end of the third pusher which is opposite the relative first free end comprises a first inclined wall;

the third pusher is arranged in the third sliding seat so that the relative end which comprises the first inclined wall is arranged in proximity of the first end of the housing;

an end of the fourth pusher which is opposite the relative second free end comprises a second inclined wall; and the fourth pusher is arranged in the fourth sliding seat so that the relative end which comprises the second inclined wall is arranged in proximity of the first end of the housing, further comprising a fifth pusher which is arranged in the housing and maintained pressed by the first elastic means towards the first end of the housing, and which is provided with a third inclined wall for coupling with the first inclined wall of the third pusher and with a fourth inclined wall for coupling with the second inclined wall of the fourth pusher, so that a movement of the third pusher along the third sliding seat and/or of the fourth pusher along the fourth sliding seat is transmitted to the fifth pusher and from the fifth pusher to the first elastic means determining an elastic reaction.

* * * * *